US009586220B2

(12) United States Patent
Pellegrino et al.

(10) Patent No.: US 9,586,220 B2
(45) Date of Patent: Mar. 7, 2017

(54) PAINT CUP ASSEMBLY

(75) Inventors: Biagio P. Pellegrino, Niskayuna, NY (US); Clemens E. Zoellner, Bay City, MI (US); Thomas R. Nixon, Au Gres, MI (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 989 days.

(21) Appl. No.: 13/536,407

(22) Filed: Jun. 28, 2012

(65) Prior Publication Data

US 2013/0001322 A1 Jan. 3, 2013

Related U.S. Application Data

(60) Provisional application No. 61/503,504, filed on Jun. 30, 2011.

(51) Int. Cl.
*B05B 7/24* (2006.01)
*B05B 15/00* (2006.01)

(52) U.S. Cl.
CPC ..... *B05B 7/2408* (2013.01); *B05B 7/2478* (2013.01); *B05B 15/008* (2013.01)

(58) Field of Classification Search
CPC ..... F16B 21/02; F16B 21/04; F16B 21/06; F16B 21/065; F16B 5/0275; B05B 7/2408; B05B 7/2478; B65D 2543/00537; B65D 2203/12; B65D 33/255; B65D 41/04
USPC .... 239/302–379, 71–74, 601; 411/7–9, 14.5, 411/349, 549, 553
See application file for complete search history.

(56) References Cited

U.S. PATENT DOCUMENTS

| | | | |
|---|---|---|---|
| 533,489 | A | 2/1895 | Ogram |
| 758,239 | A | 4/1904 | Ducart |
| 1,370,687 | A | 3/1921 | Ferris |
| 1,556,913 | A | 10/1924 | Capra |
| 1,703,384 | A | 2/1929 | Birkenmaier |

(Continued)

FOREIGN PATENT DOCUMENTS

| | | | |
|---|---|---|---|
| AU | 200032550 | B3 | 7/2000 |
| AU | 199935838 | A1 | 1/2001 |

(Continued)

OTHER PUBLICATIONS

Amended Complaint and Demand for Jury Trial *3M Innovative Properties Company and 3M Company* vs. *Illinois Tool Works, Inc. and ITW Finishing, L.L.C.*, Case No. 06-2459 (U.S. District Court, District of Minnesota) filed Aug. 7, 2006 (5 pgs).

(Continued)

*Primary Examiner* — Arthur O Hall
*Assistant Examiner* — Alexander Valvis
(74) *Attorney, Agent, or Firm* — Abel Law Group, LLP; Joseph P. Sullivan

(57) ABSTRACT

A paint cup assembly for a paint sprayer is disclosed and can include a paint reservoir assembly. The paint reservoir assembly can include a paint reservoir and a cap configured to engage the paint reservoir. The paint reservoir assembly further includes a structural element for engaging a paint spray gun to form a tactile feedback mechanism. The tactile feedback mechanism can provide a tactile indication to a user as the paint reservoir assembly is engaged with the paint spray gun.

19 Claims, 14 Drawing Sheets

(56) References Cited

U.S. PATENT DOCUMENTS

| | | | |
|---|---|---|---|
| 1,722,101 | A | 7/1929 | Little |
| 1,748,440 | A | 2/1930 | Burdick |
| 1,843,269 | A | 2/1932 | Capser |
| 1,843,899 | A | 2/1932 | Martinet |
| 2,004,574 | A | 6/1935 | Gee, Jr. |
| 2,005,026 | A | 6/1935 | Ellsworth |
| 2,051,518 | A | 8/1936 | Cunningham |
| D105,960 | S | 9/1937 | Lieberman |
| 2,177,032 | A | 10/1939 | Baumgardner |
| 2,200,675 | A | 5/1940 | Northcutt |
| 2,228,861 | A | 1/1941 | Wegener |
| 2,310,633 | A | 2/1943 | Heimburger |
| 2,318,717 | A | 5/1943 | Rose |
| 2,593,639 | A | 4/1952 | Whitehouse |
| 2,593,839 | A | 4/1952 | Buc |
| 2,595,317 | A | 5/1952 | White |
| 2,606,586 | A | 8/1952 | Hill |
| 2,612,404 | A | 9/1952 | Andersson |
| 2,641,365 | A | 6/1953 | Lundeen |
| 2,656,217 | A | 10/1953 | Roche |
| 2,670,239 | A | 2/1954 | Ditch |
| 2,670,882 | A | 3/1954 | Best |
| 2,770,706 | A | 11/1956 | Vogtle et al. |
| 2,795,461 | A | 6/1957 | Durkin |
| 2,851,187 | A | 9/1958 | Hall |
| 2,877,934 | A | 3/1959 | Wallace |
| 2,901,182 | A | 8/1959 | Cragg et al. |
| 2,959,358 | A | 11/1960 | Vork |
| 3,000,576 | A | 9/1961 | Levey et al. |
| 3,035,623 | A | 5/1962 | Goetz |
| 3,066,872 | A | 12/1962 | Kobee |
| 3,134,494 | A | 5/1964 | Quinn |
| 3,136,486 | A | 6/1964 | Docken |
| 3,157,360 | A | 11/1964 | Heard |
| 3,163,544 | A | 12/1964 | Valyi |
| 3,167,210 | A | 1/1965 | Carney, Jr. |
| 3,186,643 | A | 6/1965 | George et al. |
| 3,195,819 | A | 7/1965 | Watanabe |
| 3,198,438 | A | 8/1965 | Hultgren |
| 3,211,324 | A | 10/1965 | Sapien |
| 3,227,305 | A | 1/1966 | Enssle |
| 3,236,459 | A | 2/1966 | McRitchie |
| 3,240,398 | A | 3/1966 | Dalton, Jr. |
| 3,255,972 | A | 6/1966 | Hultgren et al. |
| 3,260,464 | A | 7/1966 | Harant |
| 3,335,913 | A | 8/1967 | Bouet |
| 3,338,406 | A | 8/1967 | Anderson |
| 3,362,640 | A | 1/1968 | Fainman |
| 3,381,845 | A | 5/1968 | MacDonald |
| 3,393,842 | A | 7/1968 | Bruce et al. |
| 3,401,842 | A | 9/1968 | Morrison |
| 3,406,853 | A | 10/1968 | McLeod |
| 3,432,104 | A | 3/1969 | Kaltenbach |
| 3,487,989 | A | 1/1970 | Rausing et al. |
| 3,507,309 | A | 4/1970 | Johnson |
| 3,524,589 | A | 8/1970 | Pelton, Jr. |
| 3,593,921 | A | 7/1971 | Boltic |
| 3,606,092 | A | 9/1971 | Kollmai |
| 3,658,122 | A | 4/1972 | Kalyk |
| 3,672,645 | A | 6/1972 | Terrels et al. |
| 3,674,074 | A | 7/1972 | Lavis |
| 3,757,718 | A | 9/1973 | Johnson |
| 3,773,211 | A | 11/1973 | Bridgman |
| 3,776,408 | A | 12/1973 | Wald |
| 3,779,419 | A | 12/1973 | Heitz |
| 3,780,950 | A | 12/1973 | Brennan |
| 3,784,039 | A | 1/1974 | Marco |
| 3,790,017 | A | 2/1974 | Fitzpatrick et al. |
| 3,790,021 | A | 2/1974 | Bailey |
| 3,815,967 | A | 6/1974 | Jocelyn |
| 3,841,555 | A | 10/1974 | Lilja |
| 3,853,157 | A | 12/1974 | Madaio |
| 3,858,810 | A | 1/1975 | Seeley et al. |
| 3,892,360 | A | 7/1975 | Schlottmann et al. |
| 3,934,746 | A | 1/1976 | Lilja |
| 3,937,367 | A | 2/1976 | Hood |
| 3,939,842 | A | 2/1976 | Harris |
| 3,940,052 | A | 2/1976 | McHugh |
| 4,035,004 | A | 7/1977 | Hengesbach |
| 4,043,510 | A | 8/1977 | Morris |
| 4,067,499 | A | 1/1978 | Cohen |
| 4,069,751 | A | 1/1978 | Gronwick et al. |
| 4,088,268 | A | 5/1978 | Vohringer |
| 4,095,720 | A | 6/1978 | Delbrouck et al. |
| 4,122,973 | A | 10/1978 | Ahern |
| 4,140,279 | A | 2/1979 | Hawkins |
| 4,151,929 | A | 5/1979 | Sapien |
| 4,159,081 | A | 6/1979 | Demler et al. |
| 4,186,783 | A | 2/1980 | Brandt |
| 4,193,506 | A | 3/1980 | Trindle et al. |
| D257,668 | S | 12/1980 | Ahern |
| 4,258,862 | A | 3/1981 | Thorsheim |
| 4,307,820 | A | 12/1981 | Binoche |
| 4,321,922 | A | 3/1982 | Deaton |
| 4,339,046 | A | 7/1982 | Coen |
| 4,347,948 | A | 9/1982 | Hamada et al. |
| 4,379,455 | A | 4/1983 | Deaton |
| 4,383,635 | A | 5/1983 | Yotoriyama |
| 4,388,044 | A | 6/1983 | Wilkinson |
| 4,401,274 | A | 8/1983 | Coffee |
| 4,403,738 | A | 9/1983 | Kern |
| 4,405,088 | A | 9/1983 | Gray |
| 4,406,406 | A | 9/1983 | Knapp |
| 4,411,387 | A | 10/1983 | Stern et al. |
| 4,418,843 | A | 12/1983 | Jackman |
| 4,430,084 | A | 2/1984 | Deaton |
| 4,442,003 | A | 4/1984 | Holt |
| 4,455,140 | A | 6/1984 | Joslin |
| 4,457,455 | A | 7/1984 | Meshberg |
| 4,491,254 | A | 1/1985 | Viets et al. |
| 4,501,500 | A | 2/1985 | Terrels |
| 4,516,693 | A | 5/1985 | Gaston |
| 4,558,792 | A | 12/1985 | Cabernoch et al. |
| 4,559,140 | A | 12/1985 | Croteau |
| 4,562,965 | A | 1/1986 | Ihmels et al. |
| D283,832 | S | 5/1986 | Weinstein et al. |
| 4,586,628 | A | 5/1986 | Nittel |
| 4,621,770 | A | 11/1986 | Sayen |
| 4,623,095 | A | 11/1986 | Pronk |
| 4,625,890 | A | 12/1986 | Galer |
| 4,628,644 | A | 12/1986 | Somers |
| 4,633,052 | A | 12/1986 | Beavers et al. |
| 4,645,097 | A | 2/1987 | Kaufman |
| 4,653,691 | A | 3/1987 | Grime |
| 4,657,151 | A | 4/1987 | Cabernoch |
| D290,990 | S | 7/1987 | Izzi |
| 4,693,423 | A | 9/1987 | Roe et al. |
| 4,712,739 | A | 12/1987 | Bihn |
| 4,760,962 | A | 8/1988 | Wheeler |
| 4,781,311 | A | 11/1988 | Dunning et al. |
| 4,811,904 | A | 3/1989 | Ihmels et al. |
| 4,813,556 | A | 3/1989 | Lawrence |
| 4,813,609 | A | 3/1989 | French |
| D300,555 | S | 4/1989 | Patterson |
| 4,818,589 | A | 4/1989 | Johnson et al. |
| 4,824,018 | A | 4/1989 | Shreve |
| 4,836,764 | A | 6/1989 | Parkinson |
| 4,909,409 | A | 3/1990 | Shreve |
| 4,925,055 | A | 5/1990 | Robbins, III et al. |
| 4,930,644 | A | 6/1990 | Robbins, III |
| 4,936,511 | A | 6/1990 | Johnson et al. |
| D309,858 | S | 8/1990 | Meyersburg |
| 4,946,558 | A | 8/1990 | Salmon |
| 4,951,875 | A | 8/1990 | Devey |
| 4,961,537 | A | 10/1990 | Stern |
| 4,962,885 | A | 10/1990 | Coffee |
| 4,971,251 | A | 11/1990 | Dobrick et al. |
| 4,979,628 | A | 12/1990 | Robbins, III |
| 4,982,868 | A | 1/1991 | Robbins, III |
| 4,998,696 | A | 3/1991 | Desjardins |
| 4,999,109 | A | 3/1991 | Sabre |
| 5,005,726 | A | 4/1991 | Robbins |
| 5,035,339 | A | 7/1991 | Meyersburg |
| 5,052,623 | A | 10/1991 | Nordeen |

(56) References Cited

U.S. PATENT DOCUMENTS 5,054,687 A 10/1991 Burns et al.
5,059,319 A 10/1991 Welsh
5,060,816 A 10/1991 Robbins, III
5,069,389 A 12/1991 Bitsakos
5,071,070 A 12/1991 Hardy
5,078,322 A 1/1992 Torntore
5,078,323 A 1/1992 Frank
5,094,543 A 3/1992 Mursa
5,102,052 A 4/1992 Demarest et al.
5,102,384 A 4/1992 Ross et al.
5,118,003 A 6/1992 Pepper et al.
5,119,992 A 6/1992 Grime
5,123,571 A 6/1992 Rebeyrolle et al.
5,143,242 A 9/1992 Millasich
5,143,294 A 9/1992 Lintvedt
5,186,828 A 2/1993 Mankin
5,209,365 A 5/1993 Wood
5,209,501 A 5/1993 Smith
5,236,128 A 8/1993 Morita et al.
5,236,506 A 8/1993 Mazakas
5,238,150 A 8/1993 Williams
5,248,089 A 9/1993 Bekius
5,248,096 A 9/1993 Hoey et al.
5,253,900 A 10/1993 Snyder
D341,189 S 11/1993 Legassie et al.
5,259,400 A 11/1993 Bruno et al.
5,261,751 A 11/1993 Heinz
5,267,693 A 12/1993 Dickey
5,269,840 A 12/1993 Morris et al.
5,295,606 A 3/1994 Karwoski
5,308,647 A 5/1994 Lappi
5,326,001 A 7/1994 Holmquist et al.
5,328,095 A 7/1994 Wickenhaver
5,332,158 A 7/1994 Styne et al.
5,337,921 A 8/1994 Wilson et al.
5,341,836 A 8/1994 Doherty
5,358,402 A 10/1994 Reed et al.
5,368,395 A 11/1994 Crimmins
5,377,852 A 1/1995 Demorest
5,381,918 A 1/1995 Dahl
5,385,251 A 1/1995 Dunn
5,400,573 A 3/1995 Crystal et al.
5,405,090 A 4/1995 Greene et al.
5,415,352 A 5/1995 May
5,421,489 A 6/1995 Holzner, Sr. et al.
5,424,086 A 6/1995 Walker
5,454,488 A 10/1995 Geier
5,460,289 A 10/1995 Gemmell
5,462,711 A 10/1995 Ricottone
5,468,383 A 11/1995 McKenzie
5,492,242 A 2/1996 Gall
5,501,397 A 3/1996 Holt
5,569,377 A 10/1996 Hashimoto
5,582,350 A 12/1996 Kosmyna et al.
5,607,082 A 3/1997 Cracauer
5,617,972 A 4/1997 Morano et al.
5,631,055 A 5/1997 Vines et al.
5,655,714 A 8/1997 Kieffer et al.
5,667,858 A 9/1997 Pokorny
D386,654 S 11/1997 Kosmyna
5,695,837 A 12/1997 Everaerts et al.
5,713,519 A 2/1998 Sandison et al.
5,789,684 A 8/1998 Masek et al.
5,797,520 A 8/1998 Donahue
5,803,302 A 9/1998 Sato et al.
5,803,367 A 9/1998 Heard et al.
5,806,711 A 9/1998 Morano et al.
5,816,431 A 10/1998 Giannopoulos
5,816,501 A 10/1998 LoPresti et al.
5,826,795 A 10/1998 Holland et al.
5,829,588 A 11/1998 Bloomfield
5,853,102 A 12/1998 Jarrett
5,863,431 A 1/1999 Salzburg
5,878,899 A 3/1999 Manganiello et al.
5,921,426 A 7/1999 Randolph
5,938,016 A 8/1999 Erdtmann
5,954,273 A 9/1999 Ruta et al.
5,964,365 A 10/1999 Peeples et al.
5,967,379 A 10/1999 Crossdale et al.
5,996,427 A 12/1999 Masek et al.
6,019,294 A 2/2000 Anderson et al.
6,027,041 A 2/2000 Evans
6,053,429 A 4/2000 Chang
6,092,740 A 7/2000 Liu
D431,279 S 9/2000 Spriegel
6,196,410 B1 3/2001 Hocking
6,257,429 B1 7/2001 Kong
6,264,115 B1 7/2001 Liska et al.
6,277,478 B1 8/2001 Kurita et al.
6,287,669 B1 9/2001 George et al.
D449,381 S 10/2001 de Begon de Larouziere
6,302,445 B1 10/2001 Kugele et al.
6,371,385 B1 4/2002 Schiller et al.
6,390,386 B2 5/2002 Krohn et al.
6,394,152 B1 5/2002 Martin
D460,825 S 7/2002 Renz
6,435,426 B1 8/2002 Copp, Jr.
D462,268 S 9/2002 Schroeder et al.
6,455,140 B1 9/2002 Whitney et al.
6,475,609 B1 11/2002 Whitney et al.
6,536,684 B1 3/2003 Wei
6,536,687 B1 3/2003 Navis et al.
6,588,681 B2 7/2003 Rothrum et al.
6,595,441 B2 7/2003 Petrie et al.
6,663,018 B2 12/2003 Rothrum et al.
6,698,670 B1 3/2004 Gosis et al.
6,712,292 B1 3/2004 Gosis et al.
6,717,673 B1 4/2004 Janssen et al.
6,749,132 B2 6/2004 Pettit et al.
6,752,179 B1 6/2004 Schwartz
6,796,514 B1 9/2004 Schwartz
6,820,824 B1 11/2004 Joseph et al.
6,871,594 B1 3/2005 Estrella
6,877,677 B2 4/2005 Schmon et al.
6,899,239 B1 5/2005 Gray
6,938,836 B2 9/2005 Bouic
6,942,126 B2 9/2005 Douglas et al.
6,945,429 B2 9/2005 Gosis et al.
6,946,122 B2 9/2005 Yang
6,953,155 B2 10/2005 Joseph et al.
6,958,033 B1 10/2005 Malin
6,982,108 B2 1/2006 Janssen et al.
7,014,127 B2 3/2006 Valpey, III et al.
7,029,216 B2 * 4/2006 McKay ..... 411/6
7,083,119 B2 8/2006 Bouic et al.
7,086,549 B2 8/2006 Kosmyna et al.
7,090,148 B2 * 8/2006 Petrie et al. ..... 239/345
7,128,102 B2 10/2006 Pendleton et al.
7,143,960 B2 12/2006 Joseph et al.
7,159,734 B1 1/2007 O'Brien
7,165,732 B2 1/2007 Kosmyna et al.
7,172,139 B2 2/2007 Bouic et al.
7,188,785 B2 3/2007 Joseph et al.
7,269,969 B2 9/2007 Strickland et al.
7,296,759 B2 11/2007 Alexander et al.
7,344,040 B2 3/2008 Kosmyna et al.
7,353,964 B2 4/2008 Kosmyna
7,354,074 B2 4/2008 Kosmyna et al.
7,374,111 B2 5/2008 Joseph et al.
7,380,680 B2 6/2008 Kosmyna et al.
7,410,106 B2 * 8/2008 Escoto, Jr. ..... B05B 7/2481 239/320
7,451,884 B2 11/2008 Kuehn et al.
D582,512 S 12/2008 Fontaine
D586,059 S 2/2009 Bechtold, Jr.
7,568,638 B2 8/2009 Gehrung
7,625,016 B2 12/2009 Kosmyna et al.
D615,161 S 5/2010 Gerson et al.
7,757,972 B2 7/2010 Kosmyna et al.
7,798,421 B2 9/2010 Joseph et al.
7,798,425 B2 9/2010 Joseph et al.
7,798,426 B2 9/2010 Joseph et al.
7,798,427 B2 9/2010 Joseph et al.
7,802,763 B2 9/2010 Faller et al.

(56) References Cited

U.S. PATENT DOCUMENTS

| | | | |
|---|---|---|---|
| 7,810,744 | B2 | 10/2010 | Schmon et al. |
| 7,819,263 | B1 | 10/2010 | DiCarlo-Nelson |
| 7,819,341 | B2 | 10/2010 | Schmon et al. |
| 7,823,806 | B2 | 11/2010 | Schmon |
| 7,878,425 | B2 | 2/2011 | Handzel et al. |
| 7,921,583 | B2 | 4/2011 | Londino |
| 8,002,200 | B2 | 8/2011 | Joseph et al. |
| 8,033,413 | B2 | 10/2011 | Gerson et al. |
| 8,127,963 | B2 | 3/2012 | Gerson et al. |
| 8,201,709 | B1 | 6/2012 | Namigata et al. |
| 8,230,997 | B1 | 7/2012 | McWilliams et al. |
| 8,272,255 | B2 | 9/2012 | Halverson et al. |
| 2002/0014541 | A1 | 2/2002 | Krohn et al. |
| 2002/0121139 | A1 | 9/2002 | Purpura et al. |
| 2003/0003301 | A1 | 1/2003 | Whitney et al. |
| 2003/0008144 | A1 | 1/2003 | Whitney et al. |
| 2003/0209573 | A1 | 11/2003 | Bouic |
| 2004/0016825 | A1 | 1/2004 | Petrie et al. |
| 2004/0067350 | A1 | 4/2004 | Janssen et al. |
| 2004/0084553 | A1 | 5/2004 | Joseph et al. |
| 2004/0118941 | A1 | 6/2004 | Joseph et al. |
| 2004/0140373 | A1 | 7/2004 | Joseph et al. |
| 2004/0164182 | A1 | 8/2004 | Joseph et al. |
| 2004/0217201 | A1 | 11/2004 | Ruda |
| 2004/0232714 | A1 | 11/2004 | Coppotelli et al. |
| 2004/0256484 | A1 | 12/2004 | Joseph et al. |
| 2004/0256485 | A1 | 12/2004 | Joseph et al. |
| 2005/0029285 | A1 | 2/2005 | Gay, III et al. |
| 2005/0045146 | A1 | 3/2005 | McKay et al. |
| 2005/0067502 | A1 | 3/2005 | Bouic et al. |
| 2005/0092770 | A1 | 5/2005 | Yechouron |
| 2005/0145718 | A1 | 7/2005 | Blette et al. |
| 2005/0145723 | A1 | 7/2005 | Blette et al. |
| 2005/0145724 | A1 | 7/2005 | Blette et al. |
| 2005/0156058 | A1 | 7/2005 | Kosmyna et al. |
| 2005/0241722 | A1 | 11/2005 | Pendleton et al. |
| 2005/0242107 | A1 | 11/2005 | Kosmyna et al. |
| 2005/0258271 | A1 | 11/2005 | Kosmyna et al. |
| 2005/0263614 | A1 | 12/2005 | Kosmyna et al. |
| 2005/0279748 | A1 | 12/2005 | Kosmyna |
| 2006/0000927 | A1 | 1/2006 | Ruda |
| 2006/0017286 | A1 | 1/2006 | Kosmyna et al. |
| 2006/0043217 | A1 | 3/2006 | Kosmyna et al. |
| 2006/0065591 | A1 | 3/2006 | Joseph |
| 2006/0102550 | A1 | 5/2006 | Joseph et al. |
| 2006/0144960 | A1 | 7/2006 | Kosmyna et al. |
| 2006/0151630 | A1 | 7/2006 | Joseph et al. |
| 2006/0157594 | A1 | 7/2006 | Cooke |
| 2006/0175433 | A1 | 8/2006 | Escoto, Jr. et al. |
| 2006/0196891 | A1 | 9/2006 | Gerson et al. |
| 2006/0273204 | A1 | 12/2006 | Joseph et al. |
| 2006/0283861 | A1 | 12/2006 | Kosmyna et al. |
| 2007/0131793 | A1 | 6/2007 | Joseph et al. |
| 2007/0158348 | A1 | 7/2007 | Kosmyna et al. |
| 2007/0252019 | A1 | 11/2007 | Peterson et al. |
| 2007/0272323 | A1* | 11/2007 | Verhaeghe ..... B05B 7/2408 141/20.5 |
| 2008/0011879 | A1 | 1/2008 | Gerson et al. |
| 2008/0054087 | A1 | 3/2008 | Joseph et al. |
| 2008/0118656 | A1 | 5/2008 | Douglas et al. |
| 2009/0072050 | A1 | 3/2009 | Ruda |
| 2009/0110861 | A1 | 4/2009 | Sherman |
| 2009/0145980 | A1 | 6/2009 | Jones |
| 2009/0166443 | A1 | 7/2009 | Joseph et al. |
| 2009/0183565 | A1 | 7/2009 | Shamoon et al. |
| 2009/0193880 | A1 | 8/2009 | Halverson et al. |
| 2009/0200309 | A1 | 8/2009 | Kosmyna et al. |
| 2010/0108783 | A1 | 5/2010 | Joseph et al. |
| 2010/0139858 | A1 | 6/2010 | Douglas et al. |
| 2010/0163645 | A1 | 7/2010 | Johnson et al. |
| 2010/0243758 | A1 | 9/2010 | Juo |
| 2010/0288772 | A1 | 11/2010 | Wambeke et al. |
| 2011/0220737 | A1 | 9/2011 | Kwon |
| 2011/0266368 | A1 | 11/2011 | Joseph et al. |
| 2012/0037529 | A1 | 2/2012 | Hall |
| 2012/0256010 | A1 | 10/2012 | Joseph et al. |
| 2012/0273583 | A1 | 11/2012 | Gerson et al. |
| 2012/0279609 | A1 | 11/2012 | Pellegrino et al. |
| 2012/0279613 | A1 | 11/2012 | Pellegrino et al. |
| 2012/0279887 | A1 | 11/2012 | Pellegrino et al. |
| 2012/0279970 | A1 | 11/2012 | Pellegrino et al. |
| 2012/0280062 | A1 | 11/2012 | Pellegrino et al. |
| 2012/0280063 | A1 | 11/2012 | Pellegrino et al. |
| 2013/0001322 | A1 | 1/2013 | Pellegrino et al. |

FOREIGN PATENT DOCUMENTS

| | | | |
|---|---|---|---|
| AU | 2004/202537 | A1 | 1/2005 |
| CA | 963436 | | 2/1975 |
| CA | 965388 | | 4/1975 |
| CA | 1006450 | | 3/1977 |
| CA | 1192852 | A | 9/1985 |
| CA | 2099763 | A1 | 7/1992 |
| CA | 2569369 | A1 | 7/1998 |
| CA | 2660187 | A1 | 7/1998 |
| CA | 2595507 | A1 | 6/2006 |
| CA | 2277096 | C | 4/2007 |
| CH | 540159 | A | 8/1973 |
| CH | 688082 | A | 5/1997 |
| CN | 1142830 | C | 3/2004 |
| DE | 534273 | C | 9/1931 |
| DE | 2412743 | A1 | 9/1975 |
| DE | 2900998 | A1 | 7/1980 |
| DE | 3020831 | A1 | 12/1981 |
| DE | 8304005 | U1 | 6/1983 |
| DE | 3439442 | A1 | 4/1986 |
| DE | 3517122 | C1 | 5/1986 |
| DE | 3507734 | A1 | 9/1986 |
| DE | 3346165 | C2 | 4/1987 |
| DE | G 8807118 | U1 | 9/1988 |
| DE | 4002190 | A1 | 8/1991 |
| DE | 4102326 | A1 | 7/1992 |
| DE | 4209258 | A1 | 9/1993 |
| DE | 19618514 | A1 | 11/1997 |
| DE | 29905100 | U1 | 6/1999 |
| DE | 20117496 | U1 | 1/2002 |
| DE | 29825015 | U1 | 3/2004 |
| DE | 29825119 | U1 | 1/2005 |
| DE | 29825120 | U1 | 2/2005 |
| DE | 98901823 | T1 | 3/2005 |
| DE | 202004003116 | U | 7/2005 |
| DE | 202004003376 | U | 7/2005 |
| DE | 202004006907 | U1 | 10/2005 |
| DE | 69831653 | T2 | 9/2006 |
| DE | 69836570 | T2 | 9/2007 |
| EP | 0092359 | A2 | 10/1983 |
| EP | 0202124 | A2 | 11/1986 |
| EP | 0230364 | A2 | 7/1987 |
| EP | 0345607 | A1 | 12/1989 |
| EP | 0388199 | A2 | 9/1990 |
| EP | 0388696 | A1 | 9/1990 |
| EP | 0467334 | A2 | 1/1992 |
| EP | 0345607 | B1 | 9/1992 |
| EP | 0230364 | B2 | 9/1994 |
| EP | 0624353 | A2 | 11/1994 |
| EP | 0634224 | A1 | 1/1995 |
| EP | 0636548 | A1 | 2/1995 |
| EP | 0678334 | A2 | 10/1995 |
| EP | 0689825 | A1 | 1/1996 |
| EP | 0636548 | B1 | 2/1997 |
| EP | 0536344 | B1 | 10/1997 |
| EP | 0847809 | A1 | 6/1998 |
| EP | 0740692 | B1 | 12/1998 |
| EP | 0624353 | B1 | 2/1999 |
| EP | 0987060 | A1 | 3/2000 |
| EP | 1123957 | A1 | 8/2001 |
| EP | 1047732 | B1 | 9/2002 |
| EP | 1366823 | A1 | 3/2003 |
| EP | 1139841 | B1 | 5/2003 |
| EP | 1047731 | B1 | 6/2003 |
| EP | 1210181 | B1 | 10/2003 |
| EP | 1415719 | A1 | 5/2004 |
| EP | 1424135 | A1 | 6/2004 |
| EP | 1435265 | A2 | 7/2004 |

(56) References Cited

FOREIGN PATENT DOCUMENTS

| | | | |
|---|---|---|---|
| EP | 1368129 | B1 | 6/2005 |
| EP | 1566223 | A2 | 8/2005 |
| EP | 1579922 | A1 | 9/2005 |
| EP | 1611960 | A1 | 1/2006 |
| EP | 1415719 | B1 | 11/2006 |
| EP | 000638176-0001 | | 1/2007 |
| EP | 1961488 | A2 | 8/2008 |
| EP | 2090372 | A2 | 8/2009 |
| EP | 2090373 | A2 | 8/2009 |
| EP | 2105208 | A2 | 9/2009 |
| EP | 1435265 | B1 | 11/2009 |
| EP | 2221112 | A2 | 8/2010 |
| EP | 1385632 | B1 | 3/2011 |
| EP | 2090372 | A3 | 11/2011 |
| EP | 2090373 | A3 | 11/2011 |
| EP | 2105208 | A3 | 11/2011 |
| FR | 1282085 | | 1/1962 |
| FR | 2631254 | A1 | 11/1989 |
| FR | 2639324 | A1 | 5/1990 |
| FR | 2798868 | A1 | 3/2001 |
| GB | 202363 | A | 8/1923 |
| GB | 256179 | A | 6/1927 |
| GB | 290866 | A | 5/1928 |
| GB | 843161 | A | 8/1960 |
| GB | 1077369 | A | 7/1967 |
| GB | 1567685 | | 5/1980 |
| GB | 2103173 | A | 2/1983 |
| GB | 2170471 | A | 8/1986 |
| GB | 2239821 | A | 7/1991 |
| GB | 2303087 | A | 2/1997 |
| JP | 52113870 | | 9/1977 |
| JP | 64-27659 | | 1/1989 |
| JP | JUM3-81879 | U | 8/1991 |
| JP | JUM 05-39671 | U | 5/1993 |
| JP | 6-328014 | A | 11/1994 |
| JP | 6-335643 | A | 12/1994 |
| JP | 7-289956 | A | 11/1995 |
| JP | A 08-133338 | | 5/1996 |
| JP | JUM 3027372 | | 5/1996 |
| JP | 8-192851 | A | 7/1996 |
| JP | 10007170 | A | 1/1998 |
| JP | 11-028394 | A | 2/1999 |
| JP | 2001508698 | A | 7/2001 |
| JP | 2001-252599 | A | 9/2001 |
| JP | 2007-130521 | | 5/2007 |
| JP | 2008-036561 | A | 2/2008 |
| JP | 2008036561 | A | 2/2008 |
| KR | 10-2007-0023711 | A | 2/2007 |
| KR | 10-2010-0052366 | A | 5/2010 |
| WO | 90-15758 | | 12/1990 |
| WO | 90-15758 | A1 | 12/1990 |
| WO | 9206794 | A1 | 4/1992 |
| WO | 92/11930 | A1 | 7/1992 |
| WO | 92/14437 | A1 | 9/1992 |
| WO | 92/19386 | A1 | 11/1992 |
| WO | 9403337 | A2 | 2/1994 |
| WO | 9408730 | A1 | 4/1994 |
| WO | 95/07762 | A1 | 3/1995 |
| WO | 95/11170 | A1 | 4/1995 |
| WO | 9519402 | A1 | 7/1995 |
| WO | 98/00796 | A2 | 1/1998 |
| WO | 98/32539 | A1 | 7/1998 |
| WO | 99/06301 | A1 | 2/1999 |
| WO | 9936477 | A1 | 7/1999 |
| WO | 9936478 | A1 | 7/1999 |
| WO | 9940580 | A1 | 8/1999 |
| WO | 99/50153 | A1 | 10/1999 |
| WO | 00/30844 | A1 | 6/2000 |
| WO | 00/38562 | A1 | 7/2000 |
| WO | 0114766 | A1 | 3/2001 |
| WO | 02072276 | A1 | 9/2002 |
| WO | 02/085533 | A1 | 10/2002 |
| WO | 03/006170 | A2 | 1/2003 |
| WO | 03/045575 | A1 | 6/2003 |
| WO | 03095101 | A1 | 11/2003 |
| WO | 2004030938 | A1 | 4/2004 |
| WO | 2004030939 | A1 | 4/2004 |
| WO | 2004/037432 | A1 | 5/2004 |
| WO | 2004/037433 | A1 | 5/2004 |
| WO | 2004/060574 | A1 | 7/2004 |
| WO | 2004/060575 | A1 | 7/2004 |
| WO | 2004/082848 | A1 | 9/2004 |
| WO | 2004/094072 | A1 | 11/2004 |
| WO | 2005/077543 | A1 | 8/2005 |
| WO | 2005/115631 | A1 | 12/2005 |
| WO | 2005/118151 | A1 | 12/2005 |
| WO | 2005/120178 | A2 | 12/2005 |
| WO | 2005/120718 | A1 | 12/2005 |
| WO | 2006/002497 | A1 | 1/2006 |
| WO | 2006/065850 | A1 | 6/2006 |
| WO | 2006069015 | A1 | 6/2006 |
| WO | 2006098799 | A3 | 9/2006 |
| WO | 2007/037921 | A1 | 4/2007 |
| WO | 2007075724 | A2 | 7/2007 |
| WO | 2006098799 | A9 | 9/2007 |
| WO | 2007/149760 | A2 | 12/2007 |
| WO | 2007/149760 | A3 | 12/2007 |
| WO | 2008022027 | A2 | 2/2008 |
| WO | 2008060939 | A1 | 5/2008 |
| WO | 2008109733 | A1 | 9/2008 |
| WO | 2008154559 | A1 | 12/2008 |
| WO | 2009058466 | A1 | 5/2009 |
| WO | 2009/076150 | A2 | 6/2009 |
| WO | 2009/076150 | A3 | 6/2009 |
| WO | 2009120547 | A2 | 10/2009 |
| WO | 2012/068316 | A2 | 5/2012 |
| WO | 2012/154619 | A2 | 11/2012 |
| WO | 2012/154621 | A2 | 11/2012 |
| WO | 2012/154622 | A2 | 11/2012 |
| WO | 2012/154623 | A2 | 11/2012 |
| WO | 2012/154624 | A2 | 11/2012 |
| WO | 2012/154625 | A2 | 11/2012 |
| WO | 2013/003592 | A2 | 1/2013 |

OTHER PUBLICATIONS

Answer and Counter-Claim to amended Complaint, *3M Innovative Properties Company and 3M Company* vs. *Illinois Tool Works, Inc. and ITW Finishing, L.L.C.,* Case No. 06-2459 (U.S. District Court, District of Minnesota) filed Aug. 21, 2006 (8 pgs).

Answer of Defendants Demand for Jury Trial, *3M Innovative Properties Company and 3M Company* vs. *Louis M. Gerson Co., Inc., and Gerson Professional Products, Inc.,* Civil No. 08-04960 JRT-FLN (U.S. District Court, District of Minnesota), filed Oct. 15, 2008 (4 pages).

Complaint and Demand for Jury Trial, *3M Innovative Properties Company and 3M Company* vs. *Illinois Tool Works, Inc. and ITW DeVilbiss,* Case No. 06-2459 (U.S. District Court, District of Minnesota), filed Jun. 16, 2006 (29 pgs).

Complaint and Demand for Jury Trial, *3M Innovative Properties Company and 3M Company* vs. *Louis M. Gerson Co, Inc., and Gerson Professional Products, Inc.,* Civil No. 08-04960 JRT-FLN (U.S. District Court, District of Minnesota), filed Aug. 19, 2008 (30 pages).

Defendants' Claim Chart, *3M Innovative Properties Company and 3M Company* vs. *Louis M. Gerson Co, Inc., and Gerson Professional Products, Inc.,* Civil No. 08-04960 JRT-FLN (U.S. District Court, District of Minnesota), filed Mar. 2, 2009 (140 pages).

Defendants' Identification of Claim Terms, Phrases or Clauses That May Require Court Construction, *3M Innovative Properties Company and 3M Company* vs. *Louis M. Gerson Co, Inc., and Gerson Professional Products, Inc.,* Civil No. 08-04960 JRT-FLN (U.S. District Court, District of Minnesota), filed Apr. 6, 2009 (3 pages).

Defendant's Prior Art Statement, *3M Innovative Properties Company and 3M Company* vs. *Illinois Tool Works, Inc. and ITW Finishing, LLC,* Case No. 06-2459 [U.S. District Court, District of Minnesota] filed Apr. 2, 2007 [12 pages].

Defendants' Prior Art Statement, *3M Innovative Properties Company and 3M Company* vs. *Louis M. Gerson Co, Inc., and Gerson*

(56) References Cited

OTHER PUBLICATIONS

*Professional Products, Inc.,* Civil No. 08-04960 JRT-FLN (U.S. District Court, District of Minnesota), filed Mar. 2, 2009 (46 pages).
DeVilbiss PT-500, 510 and 520 2 ½ Gallon Pressure Tank service bulletin—SB-21-041-B., 6 pages.
DeVilbiss Products PT-500, 510 and 520 2 ½ Gallon Pressure Tank, Oct. 1998, 7 pages.
DeVilbiss Industrial Distributor Net Price List Spray Equipment, DDP-104, Supplement 1, Oct. 1, 1988, 3 pages.
Falkman, M.A. Plastic Discs Scrap Waste for Disposable Containers. Packaging Digest, Jun. 1996, 2 pages.
Louis M. Gerson Co., Inc. and Gerson Professional Products, Inc. Answers to 3M's First Set of Interrogatories to Gerson (Nos. 1-22), *3M Innovative Properties Company and 3M Company* vs. *Louis M. Gerson Co, Inc., and Gerson Professional Products, Inc.,* Civil No. 08-04960 JRT-FLN (U.S. District Court, District of Minnesota), filed Dec. 11, 2008 (14 pages).
Notice of Opposition and Grounds of Opposition to European Patent No. Ep 0954381, *Illinois Tool Works, Inc.* vs. *3M Company,* dated Jun. 19, 2006, 21 pp.
Plaintiffs' Claim Chart, *3M Innovative Properties Company and 3M Company* vs. *Louis M. Gerson Co, Inc., and Gerson Professional Products, Inc.,* Civil No. 08-04960 JRT-FLN (U.S. District Court, District of Minnesota), filed Feb. 2, 2009 (52 pages).
Plaintiffs' Prior Art Statement, *3M Innovative Properties Company and 3M Company* vs. *Louis M. Gerson Co, Inc., and Gerson Professional Products, Inc.,* Civil No. 08-04960 JRT-FLN (U.S. District Court, District of Minnesota), filed Apr. 1, 2009 (25 pages).
SATA Jet 90, Operating Instructions, SATA-Fabspritztechnik GmH & Co., 6 pages.
SATA GmbH & Co. KG, "SATA RPS—The cup system for mixing and painting", K-126995/4022-063, 4 pages.
Service Bulletin, SB-4-043-D, Replaces SB-4-043-C, De Vilbiss, "120175 (GFC-502) 32 Oz. Aluminum Gravity Feed Cup with Disposable Lid and Cup Liner", May 2000.
Service Bulletin; SB-21-041-B, replaces SB-21-041-A, PT-500, 510, and 520 2 ½ Gallon Pressure Tank, Oct. 1987 product literature, 6 pages.
International Search Report for PCT Application No. PCT/US05/45146 dated Apr. 21, 2006.
International Search Report for PCT Application No. PCT/US11/61091 dated May 11, 2012.
International Search Report for PCT Application No. PCT/US12/36680 dated Nov. 16, 2012.
International Search Report for PCT Application No. PCT/US12/36684 dated Nov. 23, 2012.
International Search Report for PCT Application No. PCT/US12/36682 dated Nov. 23, 2012.
International Search Report for PCT Application No. PCT/US12/36685 dated Nov. 23, 2012.
International Search Report for PCT Application No. PCT/US12/36686 dated Nov. 23, 2012.
International Search Report for PCT Application No. PCT/US12/36687 dated Nov. 30, 2012.
Inter Partes Reexamination of U.S. Pat. No. 7,374,111 filed Dec. 9, 2008, issued Reexamination No. 95/000,422, 86 pages.
International Search Report for PCT Application No. PCT/US12/44648 dated Jan. 24, 2013.
U.S. Appl. No. 13/728,678, filed Dec. 27, 2012, entitled "Convertible Paint Cup Assembly With Air Inlet Valve".
International Search Report for PCT Application No. PCT/US2012/071843 dated Apr. 29, 2013.

* cited by examiner

PAINT CUP ASSEMBLY

CROSS-REFERENCE TO RELATED APPLICATION(S)

The present application claims priority from U.S. Provisional Patent Application No. 61/503,504, filed Jun. 30, 2011, entitled "PAINT CUP ASSEMBLY," naming inventors Biagio P. Pellegrino, Clemens E. Zoellner, and Thomas R. Nixon, which application is incorporated by reference herein in its entirety.

FIELD OF THE DISCLOSURE

The present disclosure is directed to a paint cup assembly and to a paint cup assembly having a tactile feedback mechanism.

BACKGROUND

Spray guns can be used for rapidly coating surfaces with liquids, such as paint. Paint can be contained in a container that attaches to the spray gun. The outlet of the container can be a releasably connectable coupling that connects to the spray gun. Paint can flow from the container into the spray gun and then, fed to a spray nozzle. The spray nozzle can combine the paint with air, atomize the liquid, and form a spray. At the end of the spraying operation, the container and the mating connection to the spray gun should be thoroughly cleaned so that the paint from one operation does not contaminate the paint to be sprayed in the next spraying operation. Additionally, the coupling between container and spray gun should be free of any dried liquid that might interfere with the connection between container and spray gun. A container with a lid and a disposable cup or liner can be used to eliminate or reduce the labor required to clean the container and the coupling to the spray gun.

BRIEF DESCRIPTION OF THE DRAWINGS

Embodiments are illustrated by way of example and are not limited in the accompanying figures.

Skilled artisans appreciate that elements in the figures are illustrated for simplicity and clarity and have not necessarily been drawn to scale. For example, the dimensions of some of the elements in the figures can be exaggerated relative to other elements to help to improve understanding of embodiments of the invention. The use of the same reference symbols in different drawings indicates similar or identical items.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but can include other features not expressly listed or other features that are inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the embodiments of the disclosure. This description should be read to include one or at least one and the singular also includes the plural, or vice versa, unless it is clear that it is meant otherwise.

Unless otherwise defined, all technical and scientific terms used herein have the same meaning as commonly understood by one of ordinary skill in the art to which this disclosure belongs. The materials, methods, and examples are illustrative only and not intended to be limiting.

Figure 1:
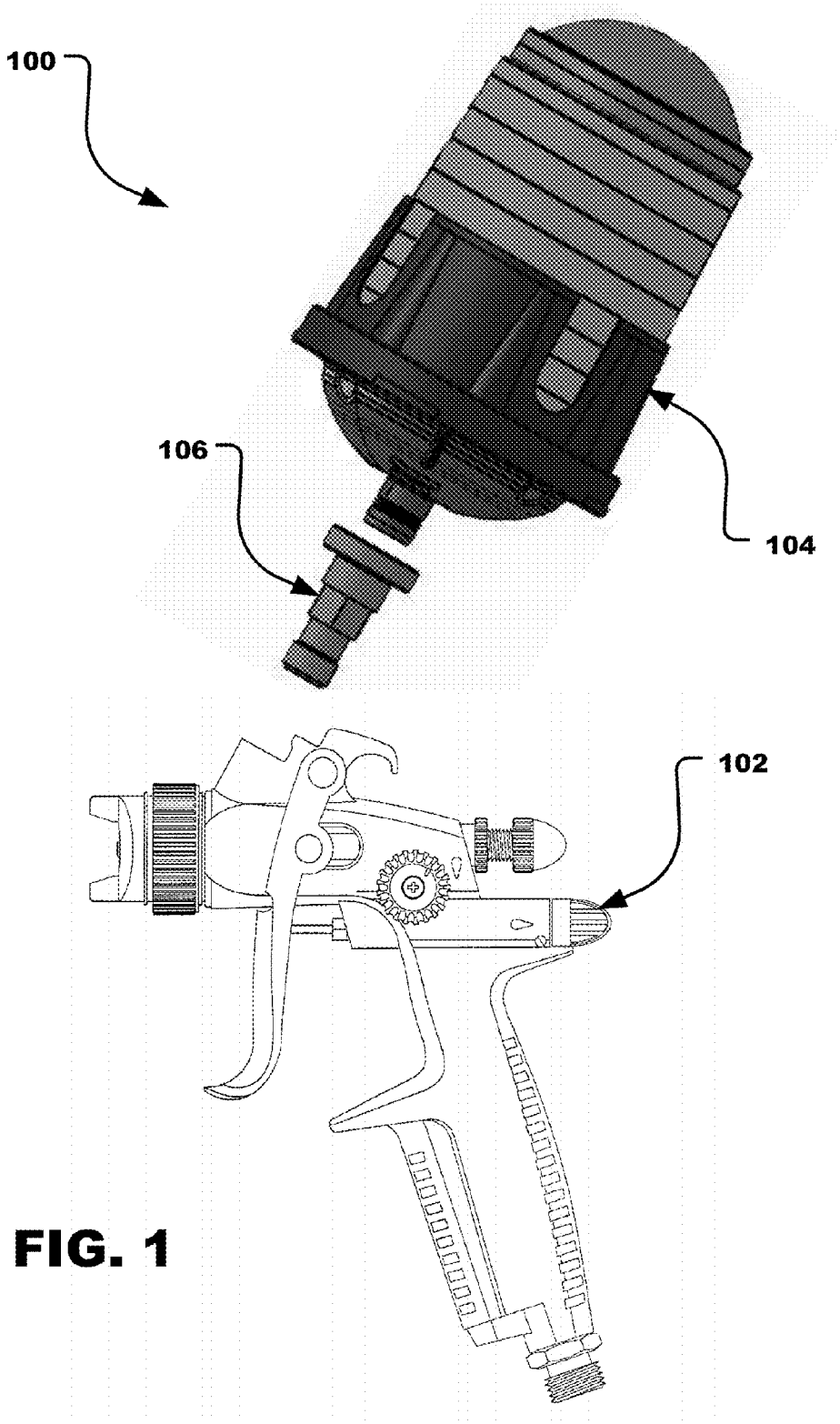
FIG. 1 includes a plan view of a paint sprayer assembly in accordance with a particular embodiment.

Referring initially to FIG. 1, a paint sprayer assembly is illustrated and is generally designated 100. As illustrated, the paint sprayer assembly 100 includes a paint spray gun 102 and a paint cup assembly 104 that can be removably engaged with the paint spray gun 102 via an adapter 106. In a particular aspect, the adapter 106 can be threadably engaged with the paint spray gun 102 and the paint cup assembly 104 can be inserted into the adapter 104. Further, during operation of the paint spray gun 102, the paint cup assembly 104 can be in fluid communication with the paint spray gun 102. Specifically, the paint cup assembly 104 can deliver paint to the paint spray gun 102 and the paint spray gun 102 can be used to transmit the fluid, e.g., paint, to a substrate, e.g., a car body.

FIG. 2 through FIG. 9 illustrate details concerning the paint cup assembly 104 that is depicted in FIG. 1 in conjunction with the paint spray gun 102. Specifically, FIG. 2 and FIG. 3 include details concerning the paint cup assembly 104 in its entirety and FIG. 4 through FIG. 9 illustrate details concerning various component parts of the paint cup assembly 104.

Figure 2:
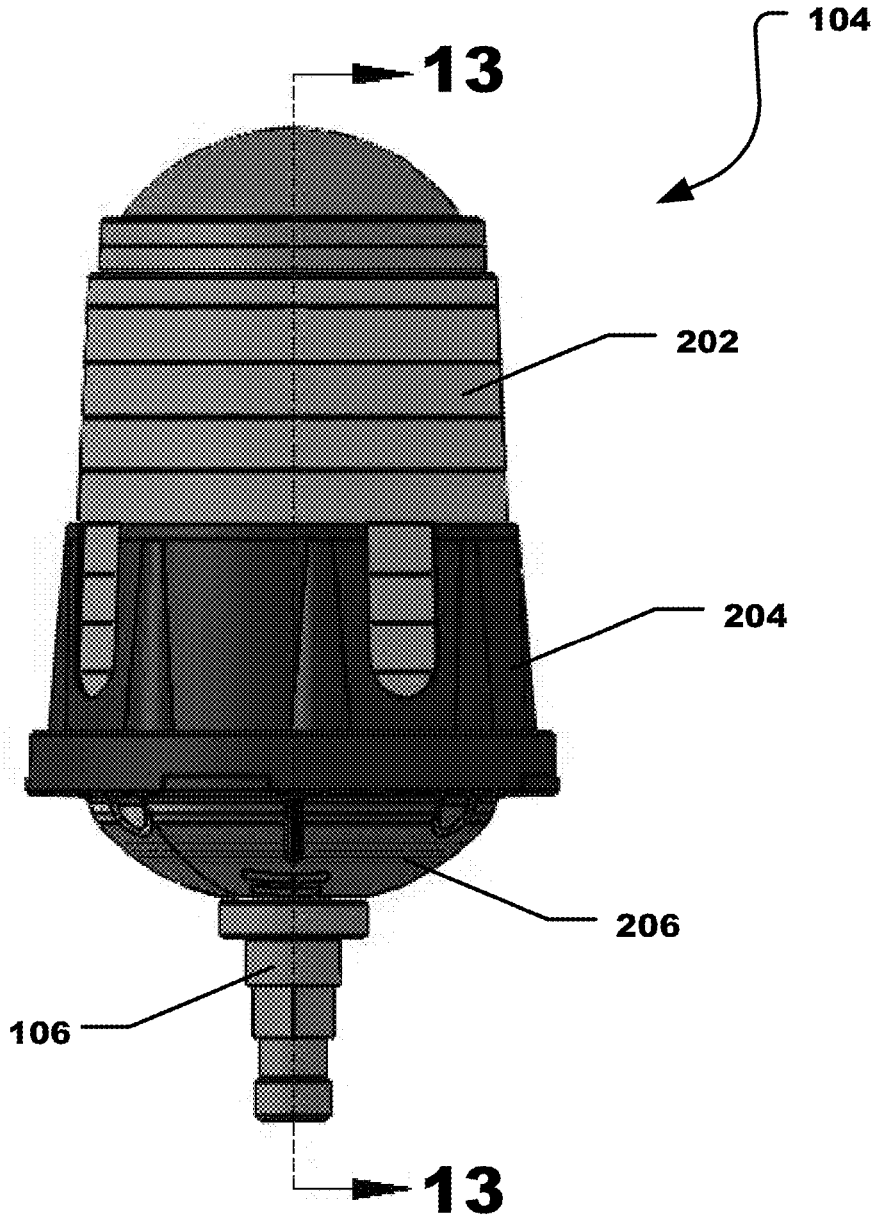
FIG. 2 includes a plan view of a paint cup assembly engaged with an adapter in accordance with a particular embodiment.
Figure 3:
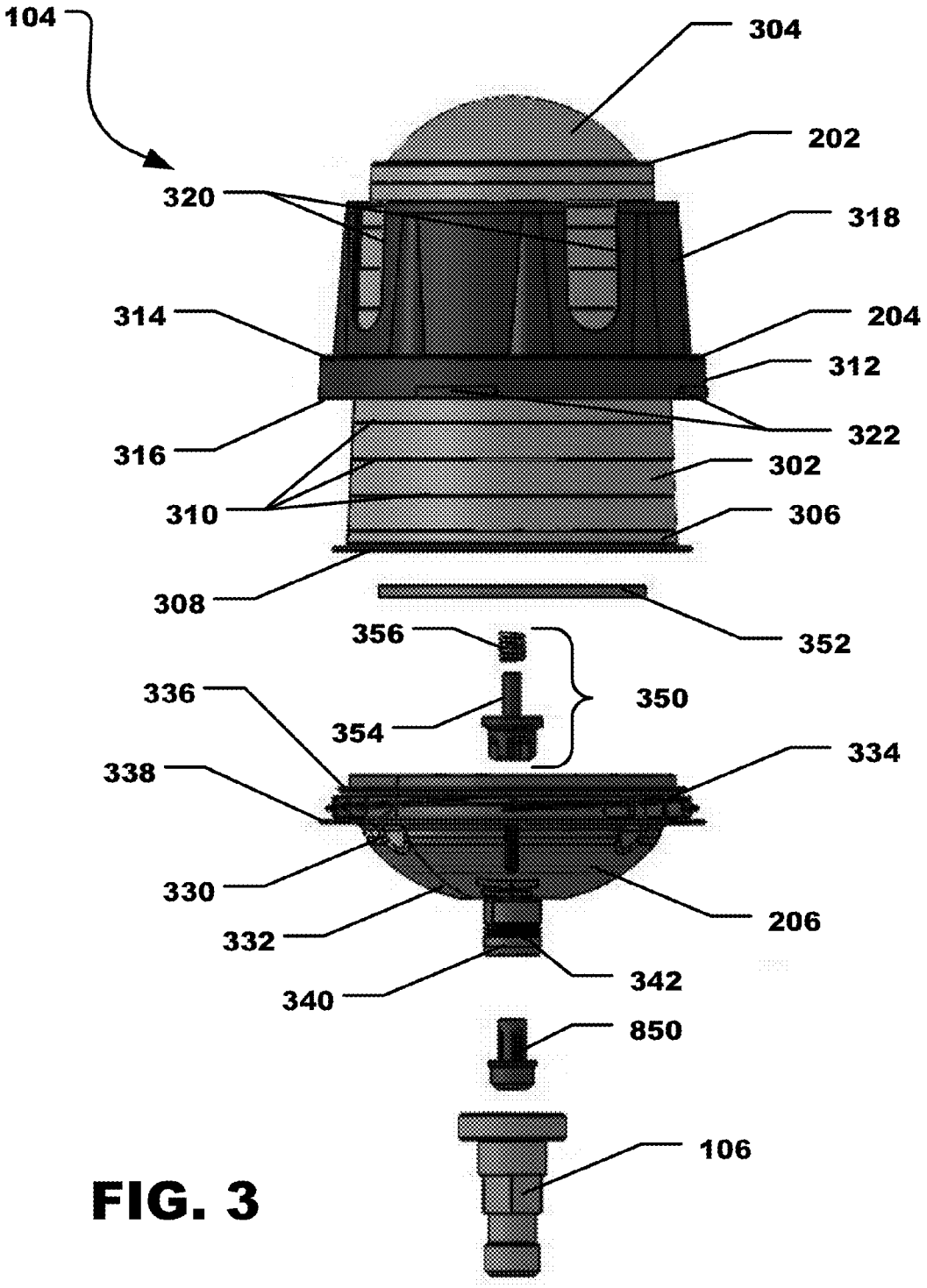
FIG. 3 includes an exploded plan view of a paint cup assembly and an adapter in accordance with a particular embodiment.

As indicated in FIG. 2 and FIG. 3, the paint cup assembly 104 can include a paint reservoir, e.g., a paint liner 202. The paint cup assembly 104 can also include an extended ring 204 that can at least partially surround the paint liner 202. In a particular aspect, the extended ring 204 can include an axial extension, e.g., a skirt, that can extend toward a closed proximal end of the paint liner such that the ring can be configured to allow a user to grasp the paint cup assembly without collapsing the paint liner during attachment with a paint sprayer. As illustrated, the paint cup assembly 104 can include a cap 206 that can be threadably engaged with the extended ring 204. As described in detail below, the cap 206 can engage the adapter 106 in order for the paint cup assembly 104 to be attached to a spray gun (not illustrated).

FIG. 3 indicates that the paint liner 202 can include a hollow body 302 that defines a proximal end 304 and a distal end 306. The hollow body 302 can be generally frustoconical. The proximal end 304 of the hollow body 302 can be closed. Further, the proximal end 304 of the hollow body 302 can be rounded. The distal end 306 of the hollow body 302 can be open and can facilitate filling the paint liner 202 with paint, as described in detail below. The hollow body 302 can also include a rim 308 that circumscribes the distal end 306 of the hollow body 302. When the extended ring 204 is engaged with the cap 206, the rim 308 of the paint liner 202 can be captured, or otherwise trapped, between the extended ring 204 and the cap 206.

In a particular aspect, the paint liner 202, including the hollow body 302, can be transparent. In another aspect, the paint liner 202, including the hollow body 302, can be translucent. In still another aspect, the paint liner 202, including the hollow body 302, can be opaque. In still another aspect, portions of the paint liner 202 can be opaque and other portions can be transparent, translucent, or a combination thereof. For example, the paint liner 202 can substantially opaque with one or more transparent strips to facilitate measuring while filling the paint liner 202 with paint.

In a particular aspect, the paint liner 202 can be disposable. Further, in a particular aspect, the paint liner 202 can be collapsible. Specifically, the paint liner 202 can be collapsible as paint is withdrawn from within the paint liner 202. Also, in a particular aspect, the paint liner 202 can be constructed from low density polyethylene (LDPE).

As illustrated in FIG. 3, the paint liner 202 can include a plurality of indicia 310 spaced along the length of the hollow body 302 of the paint liner 202. Each of the indicia can be space along the length of the hollow body 302. Each of the indicia 310 can represent an incremental change in an internal volume of the paint liner. In a particular aspect, the plurality of indicia 310 can be lines that are printed, or otherwise disposed, on an exterior surface of the body 302. In another aspect, the plurality of indicia 310 can be printed, or otherwise disposed, on an interior surface of the body 302. In still another aspect, the plurality of indicia 310 can be printed, or otherwise disposed, on an interior surface of the body 302 and on an exterior surface of the body 302. The indicia 310 can partially circumscribe the body 302. Alternatively, the indicia 310 can fully circumscribe the body 302.

It can be appreciated that the volume between adjacent indicia can be the same. Further, it can be appreciated that due to the tapered shape of the body 302 the spacing of the indicia along the body can vary.

In a particular aspect, each of the plurality of indicia 310 can be a raised rib extending from the body. Each of the ribs can extend internally into the body. Conversely, each of the ribs can extend externally, or outwardly, from the body.

Figure 3A:
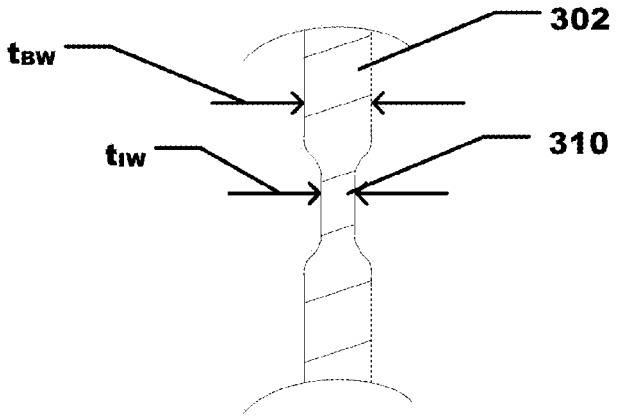
FIG. 3*a* includes a detailed cross-sectional view of a paint liner.

In another aspect, each of the indicia 310 can serve as a crush zone to facilitate collapsing of the paint liner 202 as paint is expressed from the paint liner 202 during a spraying operation. As illustrated in FIG. 3*a*, the body 302 of the paint liner 202 can have a body wall thickness, $t_{BW}$, and each of the indicia 310 can have an indicia wall thickness, $t_{IW}$, and the indicia wall thickness can be less than the body wall thickness.

In a particular aspect, the indicia wall thickness can be less than or equal to ninety percent (90%) of the body wall thickness. In another aspect, the indicia wall thickness can be less than or equal to eighty-five percent (85%) of the body wall thickness. In yet another aspect, the indicia wall thickness can be less than or equal to eighty percent (80%) of the body wall thickness. In still another aspect, the indicia wall thickness can be less than or equal to seventy-five percent (75%) of the body wall thickness. In another aspect, the indicia wall thickness can be less than or equal to seventy percent (70%) of the body wall thickness. In still yet another aspect, the indicia wall thickness can be less than or equal to sixty-five percent (65%) of the body wall thickness. In yet another aspect, the indicia wall thickness can be less than or equal to sixty percent (60%) of the body wall thickness.

In another aspect, the indicia wall thickness can be less than or equal to fifty-five percent (55%) of the body wall thickness. In still another aspect, the indicia wall thickness can be less than or equal to fifty percent (50%) of the body wall thickness. In another aspect, the indicia wall thickness can be less than or equal to forty-five percent (45%) of the body wall thickness. In another aspect, the indicia wall thickness can be less than or equal to forty percent (40%) of the body wall thickness. In yet another aspect, the indicia wall thickness can be less than or equal to thirty-five percent (35%) of the body wall thickness. Further, in another aspect, the indicia wall thickness can be less than or equal to thirty percent (30%) of the body wall thickness. In still another aspect, the indicia wall thickness can be less than or equal to twenty-five percent (25%) of the body wall thickness. In another aspect, the indicia wall thickness may not be less than twenty percent (20%) of the body wall thickness. Further, the indicia wall thickness can be within a range between and including any of the percentage of body wall thickness values described herein.

Returning to FIG. 3, the extended ring 204 can include a hub 312 having a proximal end 314 and a distal end 316. As illustrated, a skirt 318 can extend longitudinally from the proximal end 314 of the hub 312. The skirt 318 can be formed with a plurality of slots 320. The slots 320 can allow a user to see the indicia 310 on the paint liner 202 while filling the paint liner 202 with paint.

FIG. 3 indicates that the distal end 316 of the hub 312 can be formed with a plurality of teeth 322 that extend radially outward from the hub 312. Accordingly, when viewed from the distal end 316, the hub 312 of the extended ring 204 can have a gear, or cog, shape. This gear, or cog, shape can be configured to key the paint cup assembly 104 to a filling station, described in detail below, during filling. Specifically, the gear shape can be configured to fit into a correspondingly shaped hole formed in a filling station in order to prevent the paint cup assembly 104 from rotating within the hole as the extended ring 204 is engaged with the cap 206.

The hub 312 can include an interior surface (not illustrated) that can be formed with a plurality of internal threads. As such, the hub 312, and the extended ring 204, can be configured to threadably engage the cap 206. When assembled, as illustrated in FIG. 2, the skirt 318 of the extended ring 204 can at least partially surround the paint liner 202. Further, the skirt 318 can extend at least partially along the length of the paint liner 202. In a particular aspect, the skirt 318 can be substantially rigid and the skirt 318 can be configured to be grasped without collapsing the paint liner 202. Particularly, the extended ring 204 can be constructed from twenty percent (20%) talc filled polypropylene.

As further illustrated in FIG. 3, the cap 206 of the paint cup assembly 104 can include generally hemispherical hollow body 329 having a proximal end 330 and a distal end 332. The proximal end 330 of the cap 206 can be formed with a plurality of external threads 334 that are configured to engage the internal threads (not illustrated) formed in the hub 312 of the extended ring 204. The cap 206 can also include a primary sealing structure 336 and a secondary sealing structure 338. The cap 206 can also include an external rim 339 having an external diameter. The primary sealing structure 336 can be located at a distance from the external rim 339 and the secondary sealing structure 338 can be located between the primary sealing structure 336 and the external rim 339.

During use, the extended ring 204 can be threaded onto the cap 206 and the rim 308 of the paint liner 202 can be sandwiched between the extended ring 204 and the cap 206. A primary seal can be established between the rim 308 of the paint liner 202 and the primary sealing structure 336 on the cap 206. The primary seal can substantially prevent fluid from leaking through the interface established by the paint liner 202 and the cap 206. A secondary seal can be established between secondary sealing structure 338 on the cap 206 and the hub 312 of the extended ring 204. The secondary seal can substantially prevent fluid from leaking through the interface established by the cap 206 and the extended ring 204.

Accordingly, when the paint cup assembly 104 is filled with fluid and assembled as illustrated in FIG. 1, the paint cup assembly 104 can be shaken to stir, or otherwise mix, the fluid within the paint cup assembly 104.

As illustrated in FIG. 3, the cap 206 can include an outlet tube 340 that can extend from the distal end 332 of the cap 206. Specifically, the outlet tube 340 can extend from the center of the distal end 332 of the cap 206. The outlet tube 340 can be configured to be removably engaged with the adapter 106. For example, as depicted in FIG. 3, the outlet tube 340 can be formed with external threads 342.

Figure 4:
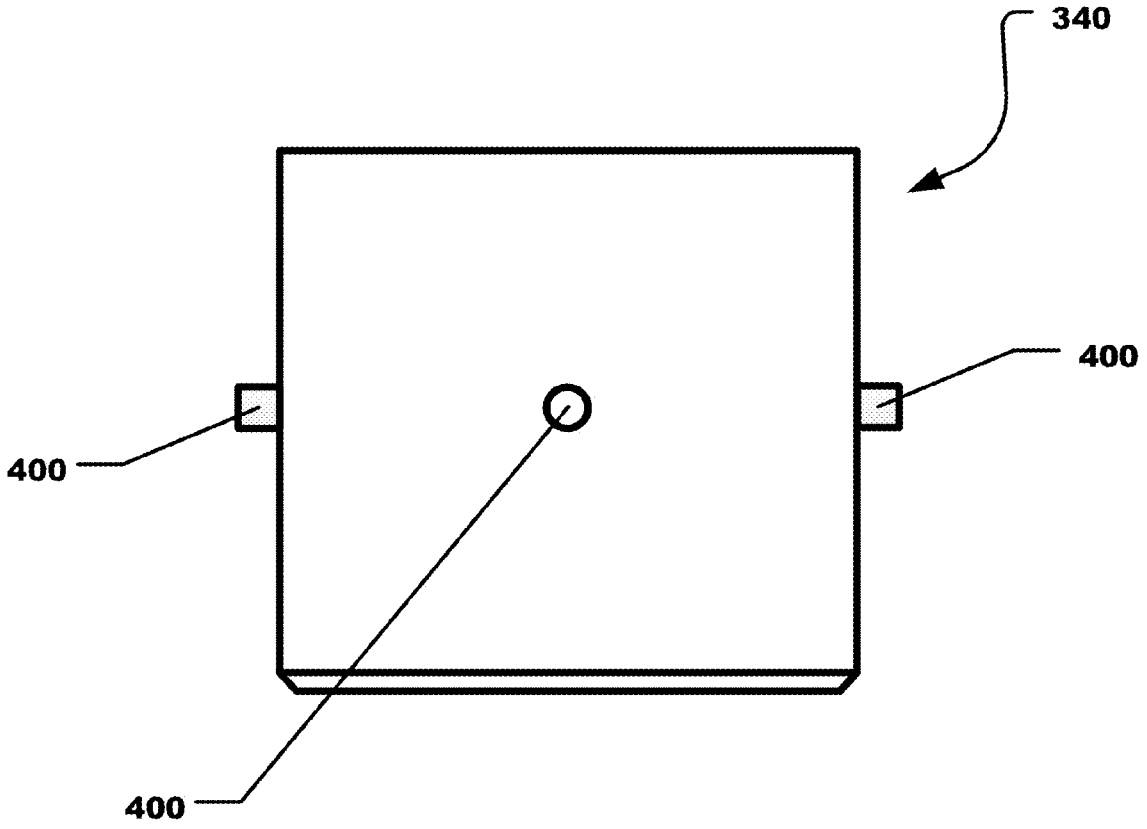
FIG. 4 includes a detailed plan view of a paint cup assembly outlet tube in accordance with a particular embodiment.

Alternatively, as illustrated in FIG. 4, the outlet tube 340 can be formed within one or more locking pins 400 that can extend radially outward from the outlet tube 340. The locking pins 400 can be configured to engage one or more grooves, or slots, formed within the adapter 106. Examples of grooves or slots formed within the adapter 106 are described below in conjunction with FIG. 10 and FIG. 11.

Figure 5:
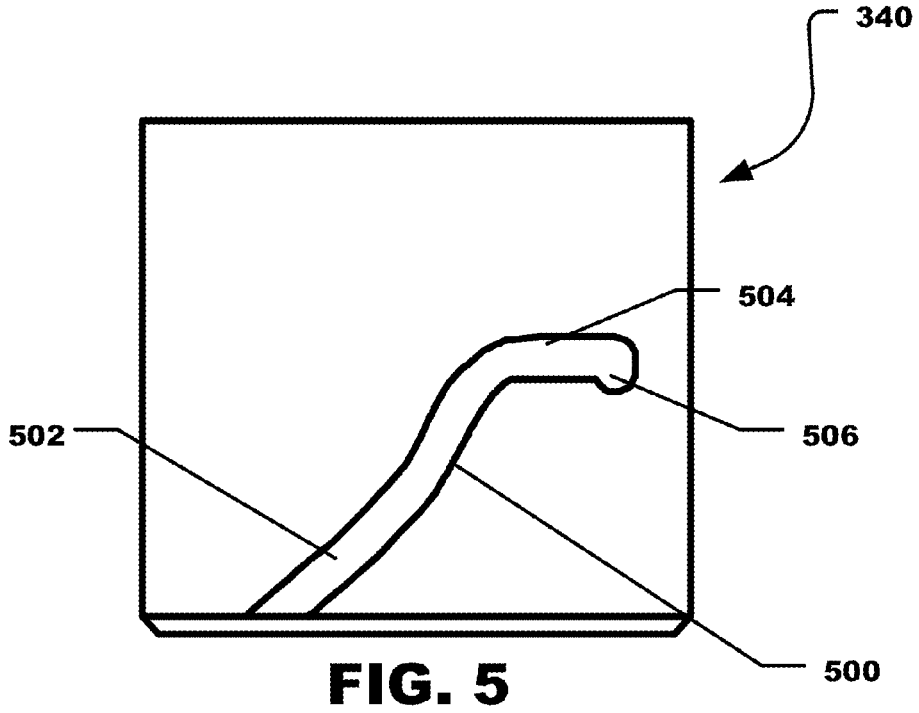
FIG. 5 includes a detailed plan view of a paint cup assembly outlet tube in accordance with another particular embodiment.

In another aspect, the outlet tube 340 can be formed with one or more grooves configured to engage one or more locking pins within the adapter. FIG. 5 illustrates one such groove, generally designated 500. As such, the groove 500 can include a generally helical portion 502 that extends to a relatively straight portion 504. The relatively straight portion 504 can be substantially parallel to the end face of the outlet tube 340. To install the paint cup assembly 104 (FIG. 3) within the adapter 106 (FIG. 3), the outlet tube 340 can be inserted into the adapter 106 (FIG. 3) such that the groove 500, or grooves, fit over corresponding locking pins. Thereafter, the paint cup assembly 104 (FIG. 3) can be rotated in order to move the groove 500, or grooves, over the locking pins until the paint cup assembly 104 (FIG. 3) is essentially locked in placed within the adapter 106 (FIG. 3).

It can be appreciated that a spring in a valve assembly, described below, can provide a biasing force to facilitate locking the paint cup assembly 104 (FIG. 3) within the adapter 106 (FIG. 3). Further, it can be appreciated that the relatively straight portion 504 can be slightly angled with respect to the end face of the outlet tube 340 in order to provide a ramped structure to further facilitate locking the paint cup assembly 104 (FIG. 3) within the adapter 106 (FIG. 3). For example, the relatively straight portion 504 can be angled in a range of one degree to twenty degrees (1°-20°) relative to a line parallel to the end face of the outlet tube 340. Additionally, the relatively straight portion 504 can terminate in a notch 506, or divot. A locking pin can move into the notch 506 and can further secure attachment of the paint cup assembly 104 (FIG. 3) to the adapter (FIG. 3).

Figure 6:
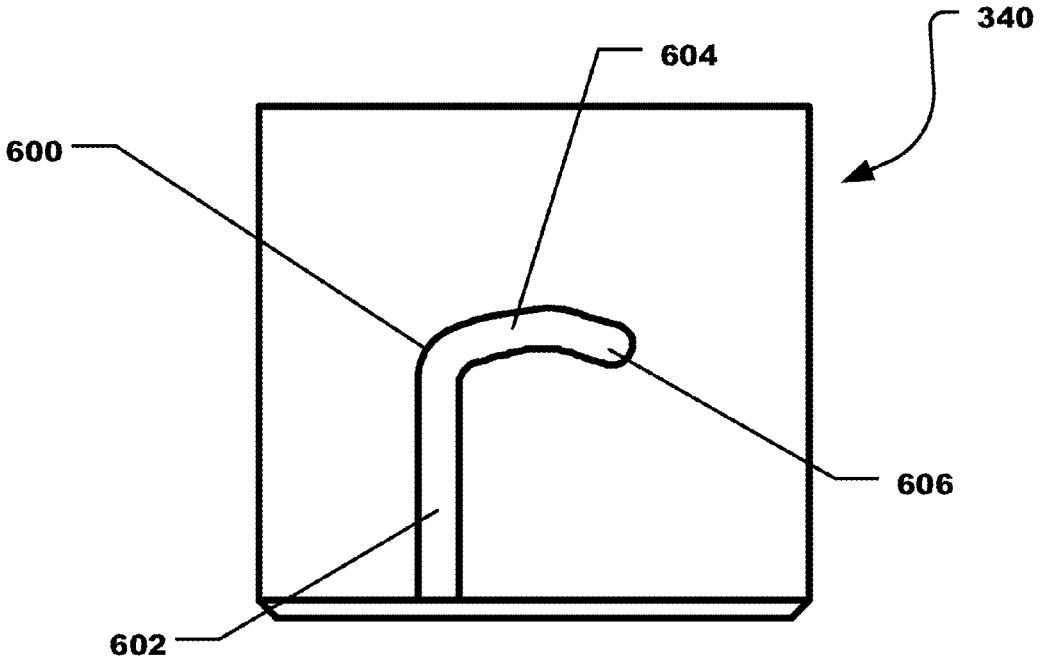
FIG. 6 includes a detailed plan view of a paint cup assembly outlet tube in accordance with a yet another particular embodiment.

FIG. 6 illustrates another groove, generally designated 600. As illustrated, the groove 600 can include a vertical portion 602 that can be substantially perpendicular to the end face of the outlet tube 304. The vertical portion 602 leads to a first angled portion 604 that can be angled away from the end face of the outlet tube 304, e.g., in a range of one degree to twenty degrees (1°-20°). The first portion 604 can be angled with respect to a line parallel to the end face of the outlet tube 304. A second angled portion 606 extends from the first angled portion 604 in the opposite direction as the first angled portion 604, i.e., toward the end face of the outlet tube 304. The second angled portion 606 can be angled in a range of one degree to twenty degrees (1°-20°). The second angled portion 606 can be angled with respect to a line parallel to the end face of the outlet tube 304.

In a particular aspect, the cap 206 can be constructed from polypropylene (PP).

Returning to FIG. 3, the paint cup assembly 104 can also include a valve assembly 350. The valve assembly 350 can be installed within the cap 206. Specifically, the valve assembly 350 can be installed within the cap 206 between the outlet tube 340 and a valve retainer 352. The valve assembly 350 can include a plunger 354 and a spring 356. In another aspect, the valve assembly 350 can include a ball (not illustrated) in lieu of a plunger.

In a particular aspect, the plunger 354 can be constructed from a thermoplastic elastomer (TPE). Further, the spring 365 can be a conical compression spring made from stainless steel.

Figure 7:
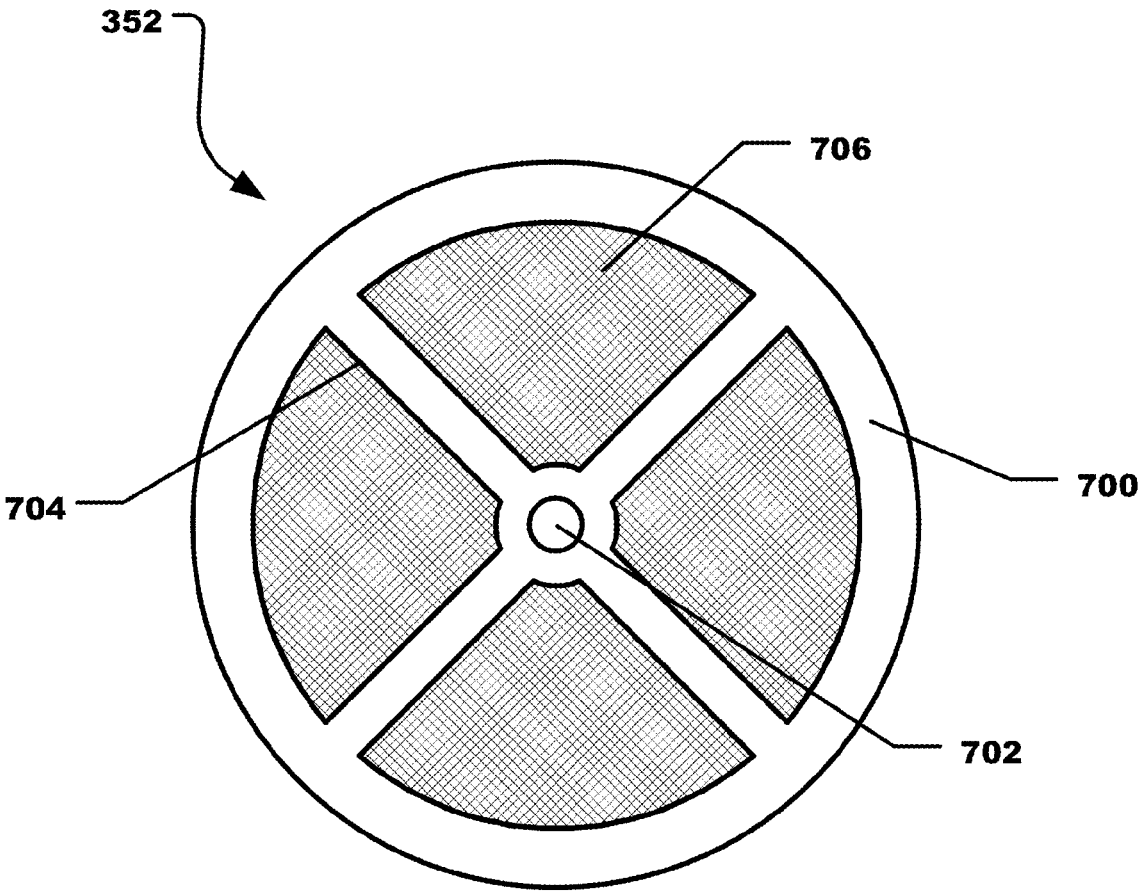
FIG. 7 includes a plan view of a valve retainer in accordance with a particular embodiment.

As illustrated in FIG. 7, the valve retainer 352 include a generally disk shaped frame 700. The frame 700 of the valve retainer 352 can be formed with a central opening 702 through which a portion of the plunger 354 can extend through after installation and during operation of the valve assembly 350, as described below. FIG. 7 depicts that the frame 700 of valve retainer 352 can include one or more windows 704, or openings, formed therein. A filter material 706, e.g., a mesh type material, can be disposed within each window 704. In a particular aspect, the frame 700 can include an upper portion and a lower portion and the filter material 706 can be sandwiched there between. In another aspect, the frame 700 can be a single piece and formed with the windows 704 and the filter material 706 can be welded to an upper surface or lower surface of the frame 700.

In a particular aspect, the frame 700 of the valve retainer 352 can be constructed from polypropylene. Further, the filter material 706 can be a mesh type material suitable for filtering a fluid such as paint.

Figure 8:
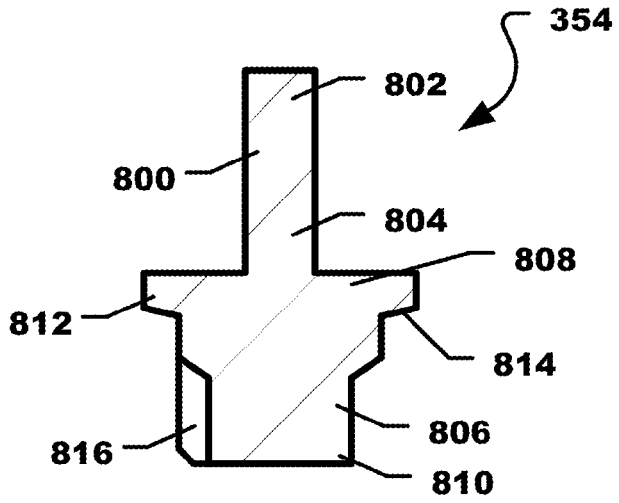
FIG. 8 includes a cross-sectional view of a valve plunger in accordance with a particular embodiment.

As illustrated in FIG. 8, the plunger 354 can include a shaft 800 that can include a proximal end 802 and a distal end 804. A head 806 can extend from the distal end 804 of the shaft 800. The head 806 of the plunger 354 can include a proximal end 808 and a distal end 810. A sealing collar 812 can extend radially from the proximal end 808 of the head 806. The sealing collar 812 can be formed with a sealing face 814. The sealing face 814 of the sealing collar 812 can be configured to engage a valve seat, described below, formed in the outlet tube 340 (FIG. 3) of the cap 206 (FIG. 3). When the sealing face 814 engages the valve seat, flow through the outlet tube 340 (FIG. 3) can be substantially blocked and the paint cup assembly 104 (FIG. 3) can be sealed.

FIG. 8 depicts that the head 806 of the plunger 354 can be formed with one or more flutes 816. The flutes 816 can facilitate fluid flow through the paint cup assembly 104 (FIG. 3) when the sealing face 814 is disengaged from the valve seat.

Figure 9:
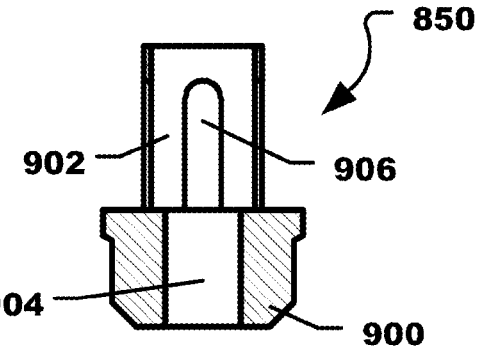
FIG. 9 includes a cross-sectional view of a valve actuator in accordance with a particular embodiment.

Returning to FIG. 3, the paint cup assembly 104 can further include the adapter 106. A valve actuator 850 can be installed within the adapter 106. FIG. 9 illustrates further details concerning the valve actuator 850 and FIG. 10 illustrates further details regarding the adapter 106.

As illustrated in FIG. 9, the valve actuator 850 can include a generally cylindrical, base 900. A generally cylindrical, hollow post 902 can extend from the base 900. As illustrated, the base 900 can be formed with a central bore 904. Further, the post 902 can be formed with one or more slots 906, or openings. The slots 906 are configured to allow fluid, e.g., paint, to flow through the post 902 and the base 900 when the valve assembly 350 (FIG. 3) is in the open configuration. In a particular embodiment, the post 902 can be configured to engage the plunger 354 (FIG. 3, FIG. 8) and move the plunger 354 linearly in order to disengage the sealing face 814 (FIG. 8) of the plunger 354 (FIG. 8) from the valve seat, described in detail below in conjunction with FIG. 13.

In a particular aspect, the valve actuator 850 can be constructed from nylon.

Figure 10:
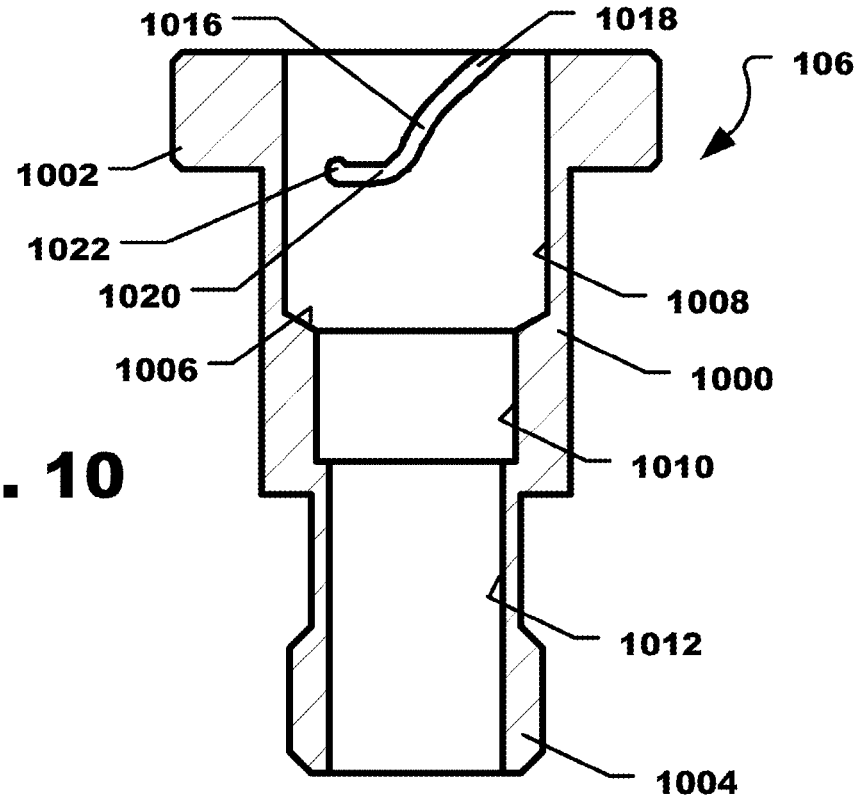
FIG. 10 includes a cross-sectional view of an adapter in accordance with a particular embodiment.

FIG. 10 depicts details concerning the construction of the adapter 106. As illustrated, the adapter 106 can include an adapter body 1000 that can define a proximal end 1002 and a distal end 1004. Further, the adapter 106 can include an internal bore 1006 along the length of the adapter body 1000. The internal bore 1006 can include a first bore portion 1008 that can extend from the proximal end 1002 of the adapter body 1000 toward the distal end 1004 of the adapter body 1000. Further, the internal bore 1006 can include a second bore portion 1010 that can extend from the first bore portion 1008 toward the distal end 1004 of the adapter body 1000. A third bore portion 1012 can extend from the second bore portion 1010 and terminate at the distal end 1004 of the adapter body 1000.

In a particular aspect, the base 900 (FIG. 9) of the valve actuator 354 (FIG. 3) can be sized and shaped to fit into the second bore portion 1010 of the internal bore 1006 formed in the adapter body 1000. Moreover, the base 900 (FIG. 9) of the valve actuator 354 (FIG. 3) can be press fitted into the second bore portion 1010.

As illustrated in FIG. 10, the first bore portion 1008 can be formed with one or more grooves 1016 that can be configured to engage one or more locking pins 400 (FIG. 4) that extend radially outward from the outlet tube 340 (FIG. 4) of the cap 206 (FIG. 3). The groove 1016 can include a generally helical portion 1018 that can extend to a relatively straight portion 1020. The relatively straight portion 1020 can be substantially parallel to the end face of the adapter 106. To install the paint cup assembly 104 (FIG. 3) within the adapter 106 (FIG. 3), the outlet tube 340 (FIG. 3) can be inserted into the adapter 106 (FIG. 3) such that the locking pins 400 (FIG. 4) fit into corresponding grooves 1016. Thereafter, the paint cup assembly 104 (FIG. 3) can be rotated in order to move the locking pins 400 (FIG. 4) within the grooves 1016 until the paint cup assembly 104 (FIG. 3) is essentially locked in placed within the adapter 106 (FIG. 3).

It can be appreciated that the relatively straight portion 1020 can be slightly angled toward to the end face of the adapter 106 in order to provide a ramped structure to further facilitate locking the paint cup assembly 104 (FIG. 3) within the adapter 106 (FIG. 3). For example, the relatively straight portion 1020 can be angled in a range of one degree to twenty degrees (1°-20°) relative to a line parallel to the end face of the adapter 106. Additionally, the relatively straight portion 1020 can terminate in a notch 1022, or divot. A locking pin can move into the notch 1022 and can further secure attachment of the paint cup assembly 104 (FIG. 3) to the adapter 106 (FIG. 3).

Figure 11:
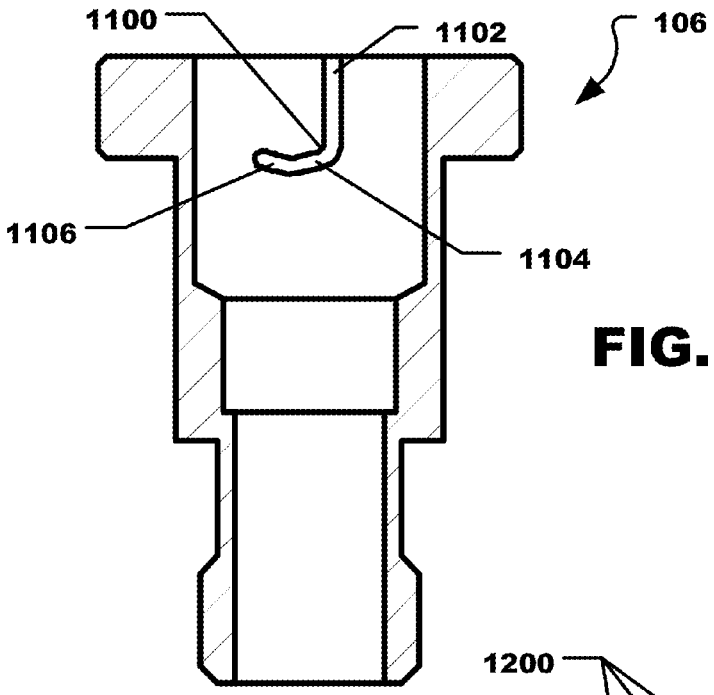
FIG. 11 includes a cross-sectional view of an adapter in accordance with another particular embodiment.

FIG. 11 illustrates another groove, generally designated 1100, that can be formed in the adapter 106. As illustrated, the groove 1100 can include a vertical portion 1102 that can be substantially perpendicular to the end face of the adapter 106. The vertical portion 1102 leads to a first angled portion 1104 that can be angled away from the end face of the adapter 106, e.g., in a range of one degree to twenty degrees (1°-20°). The first portion 1104 can be angled with respect to a line parallel to the end face of the adapter 106. A second angled portion 1106 can extend from the first angled portion 1104 in the opposite direction as the first angled portion 1104, i.e., toward the end face of the adapter 106. The second angled portion 1106 can be angled in a range of one degree to twenty degrees (1°-20°). The second angled portion 1106 can be angled with respect to a line parallel to the end face of the adapter 106.

Figure 12:
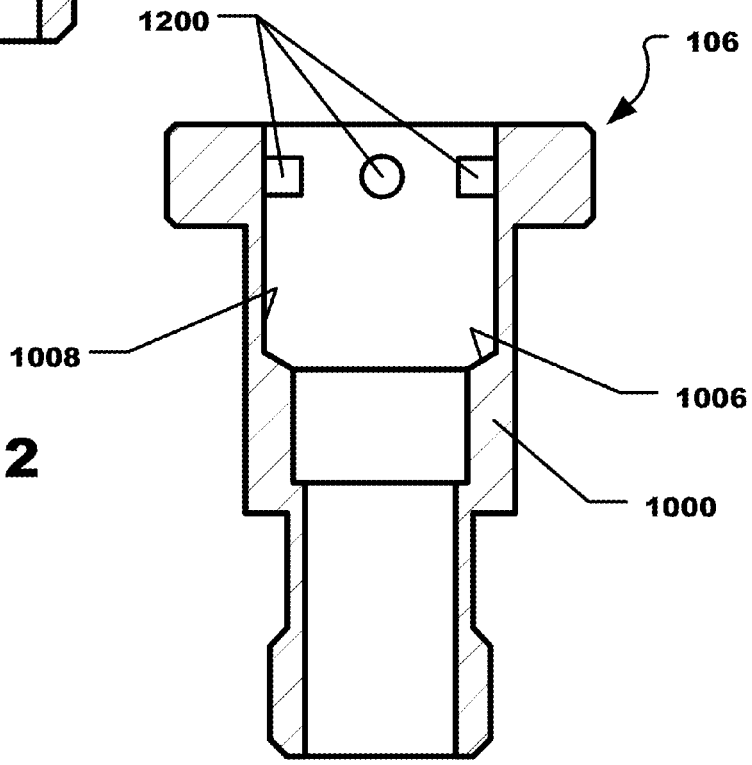
FIG. 12 includes a cross-sectional view of an adapter in accordance with yet another particular embodiment.

As illustrated in FIG. 12, in an alternative embodiment, the adapter 106 can be formed within one or more locking pins 1200 that can extend radially inward from the adapter body 1000. For example, the locking pins 1200 can extend radially inward from the wall of the first bore portion 1008 of the internal bore 1006 formed in the adapter body 1000. In a particular aspect, the locking pins 1200 can be configured to engage one or more grooves, or slots, formed within the outlet tube 340 of the cap 206.

In a particular aspect, the adapter 106 can be constructed from a metal, such as aluminum.

Figure 13:
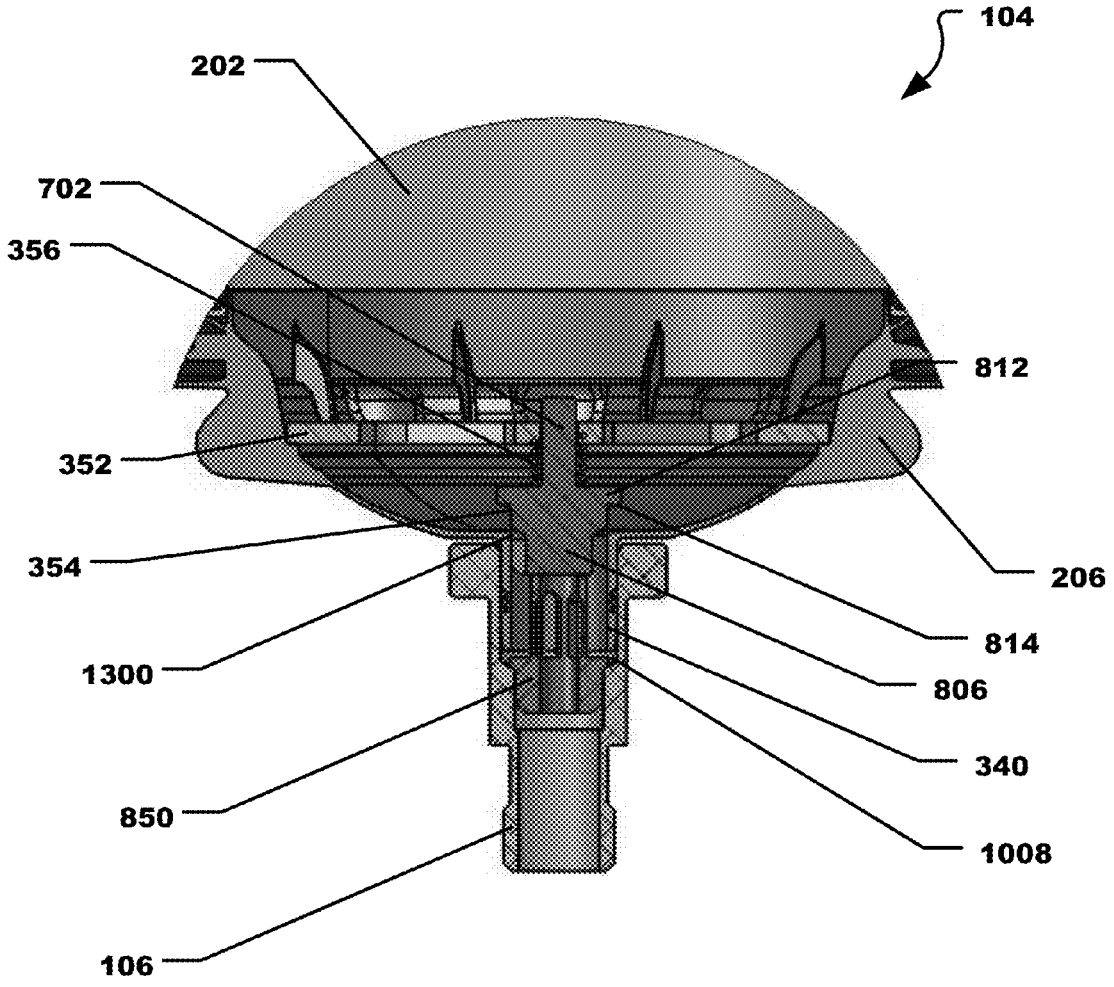
FIG. 13 includes a cross-sectional view of the paint cup assembly taken along line 13-13 in FIG. 2 in accordance with a particular embodiment.

Referring now to FIG. 13, a detailed view of the paint cup assembly 104 is illustrated. FIG. 13 depicts the outlet tube 340 of the cap 206 inserted into the first bore portion 1008 of the internal bore 1006 formed in the adapter 106. As the outlet tube 340 is inserted into the adapter 106, the valve actuator 850 within the adapter 106 can engage the plunger 354 of the valve assembly 350. Specifically, the post 902 of the valve actuator 850 can contact and engage the head 806 of the plunger 354.

The post 902 of the valve actuator 850 can cause the plunger 354 to move linearly into the cap 206 and through the valve retainer 352, e.g., through the central opening 702 of the valve retainer 352. As the plunger 354 moves as described, the spring 356 can be compressed between the valve retainer 352 and the head 806 of the plunger 354. Further, as the plunger 354 moves into the cap 206, the sealing face 814 formed on the sealing collar 812 of the head 806 can be unseated, or otherwise disengaged, from a valve seat 1300 formed within the cap 206 at the base of the outlet tube 340.

As the sealing face 814 of the head 806 is unseated from the valve seat 1300 of the outlet tube 340, fluid, e.g., paint, can flow from the paint liner 202 through the cap 206 and out of the outlet tube 340. The fluid can then flow through the valve actuator 850 and through the adapter 106 into a paint sprayer. As the fluid flows through the cap 206, the filter material 706 (FIG. 7) disposed within the valve retainer 352 can filter the fluid, e.g., to remove any dirt, dust, or other particles.

Accordingly, as illustrated in FIG. 13, the valve assembly 350 can be configured to be operable from a closed configuration in which fluid flow through the outlet tube 340 can be prevented to an open configuration in which fluid flow through the outlet tube 340 can be permitted upon engagement with a paint sprayer. In particular, the open configuration can be achieved automatically during engagement of the paint cup assembly 104 with the adapter 106 or paint sprayer (not illustrated). Further, it can be appreciated that the engagement can be achieved by reducing a distance between the paint cup assembly and the adapter 106 or paint sprayer (not illustrated). Further, in a particular embodiment, engagement can include an interference fi. In another aspect, engagement can include a threaded engagement.

Figure 14:
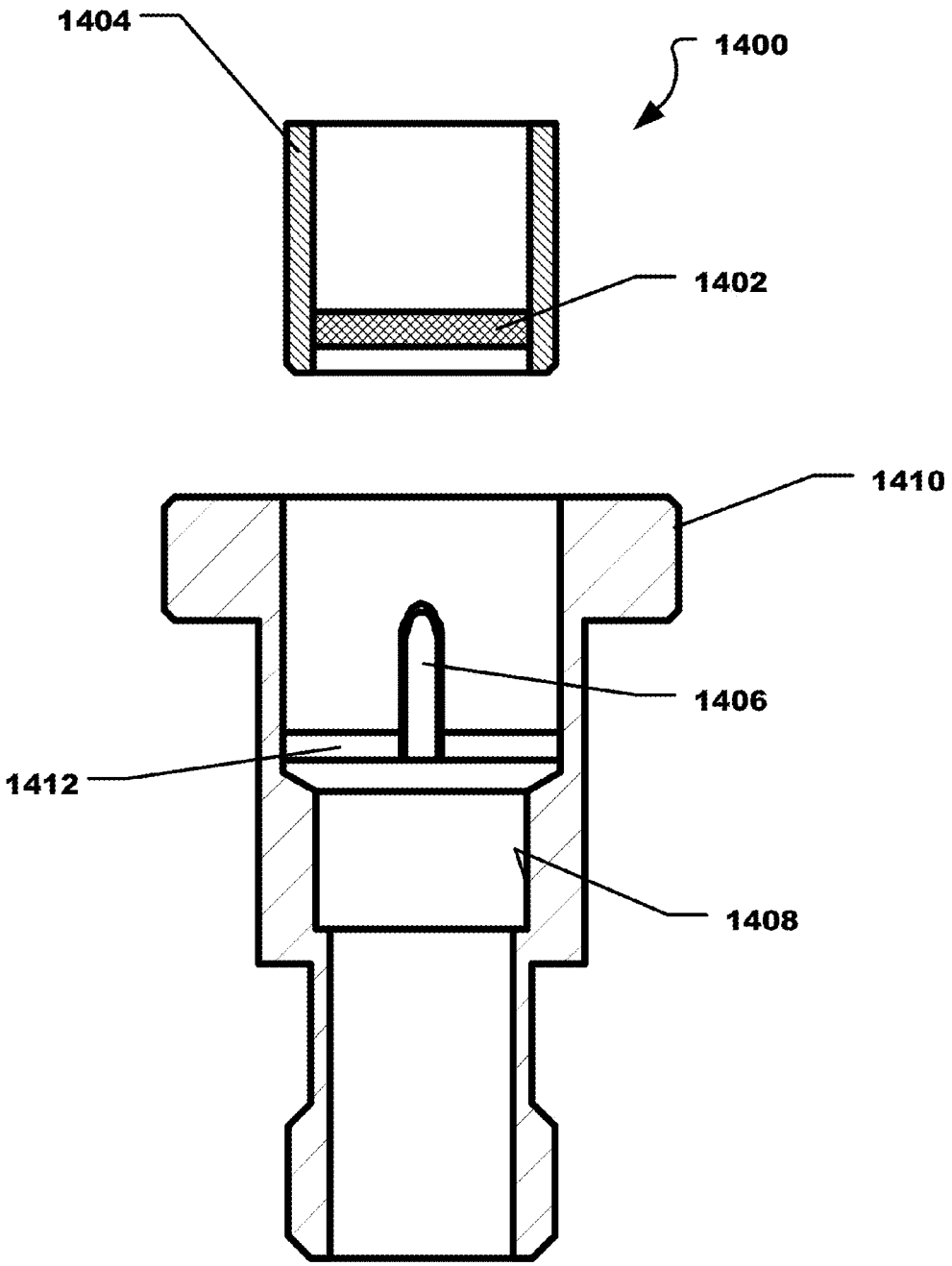
FIG. 14 includes a detailed plan view of a paint cup assembly valve assembly in accordance with another particular embodiment.

Referring to FIG. 14, a third embodiment of a valve assembly is illustrated and is designated 1400. As illustrated, the valve assembly 1400 can include a membrane 1402 disposed within an outlet tube 1404 of a cap (not illustrated). In particular aspect, the membrane 1402 can be self-sealing when a trocar is removed therefrom.

The valve assembly 1400 can further include a trocar 1406 or a similarly configured needle or piercing hollow shaft. The trocar 1406 can be disposed within an internal bore 1408 of an adapter 1410. The trocar 1406 can be supported by one or more support structures 1412 that extend radially from a base of the trocar 1406 to the wall of the internal bore 1408.

As a paint cup assembly (not illustrated) is engaged with the adapter 1410, the outlet tube 1404 of the cap (not illustrated) can be inserted into the internal bore 1408 of the adapter 1410. Further, as the outlet tube 1404 is pushed into the adapter, the trocar 1406 can pierce the membrane 1402 in order to permit fluid flow out of the paint cup assembly (not illustrated) and through the adapter 1410 into a paint sprayer (not illustrated).

When the paint cup assembly (not illustrated) is disengaged from the adapter 1410, the trocar 1406 can be retracted, or otherwise removed, from the membrane 1402. Once the trocar 1406 is removed from the membrane 1402, the membrane 1402 can seal the hole formed at the location within the membrane 1402 in which the trocar 1406 pierced the membrane 1402. As such, if the paint cup assembly (not illustrated) remains at least partially filled with fluid, leakage of the fluid can be substantially minimized.

Figure 15:
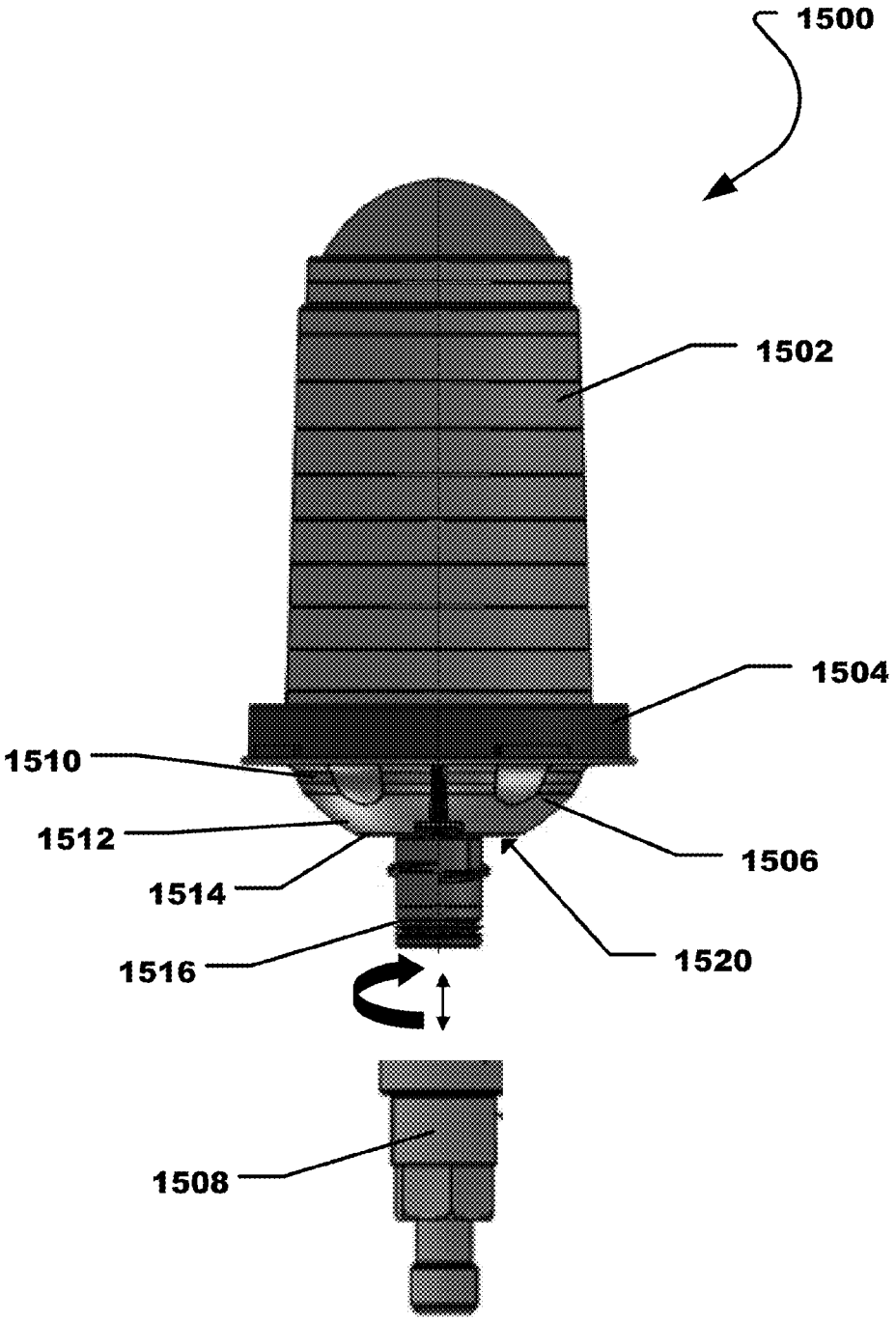
FIG. 15 includes a plan view of a paint cup assembly in accordance with another particular embodiment.
Figure 16:
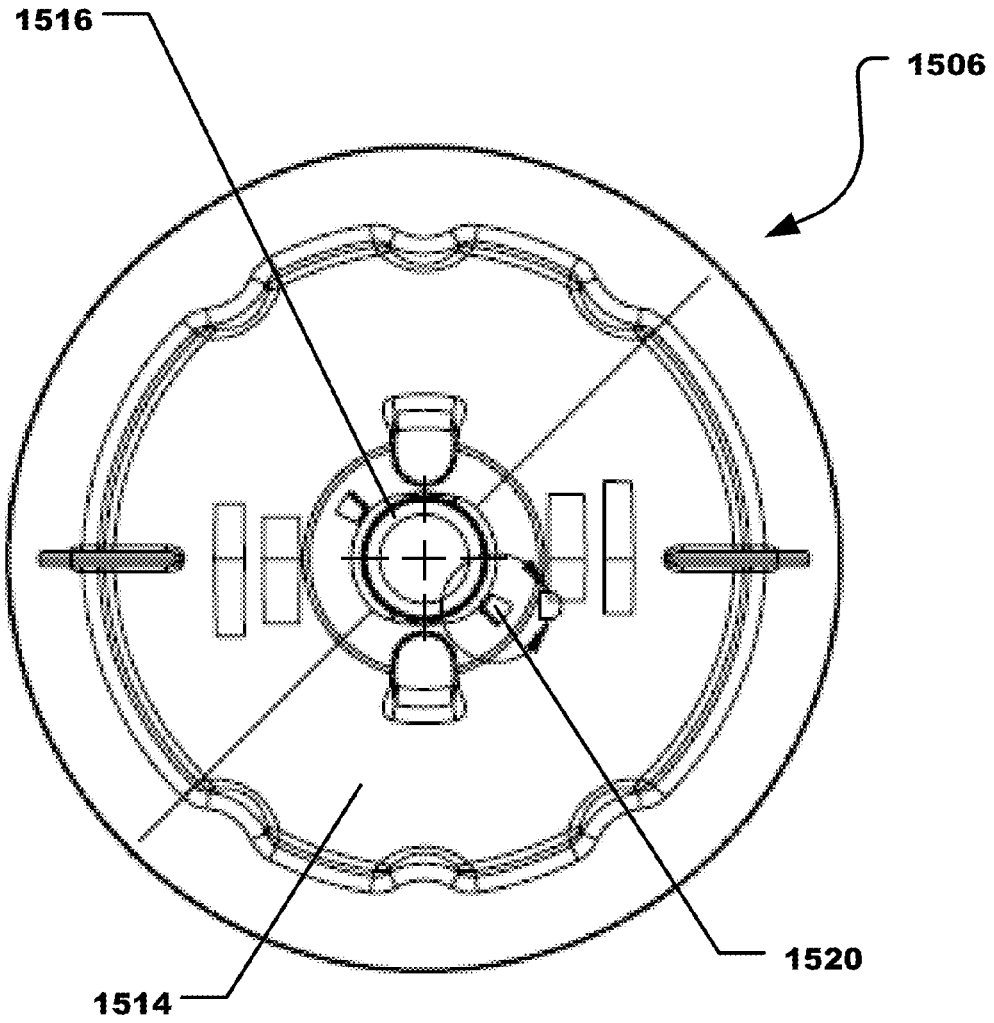
FIG. 16 includes another plan view of a paint cup assembly in accordance with a particular embodiment.
Figure 17:
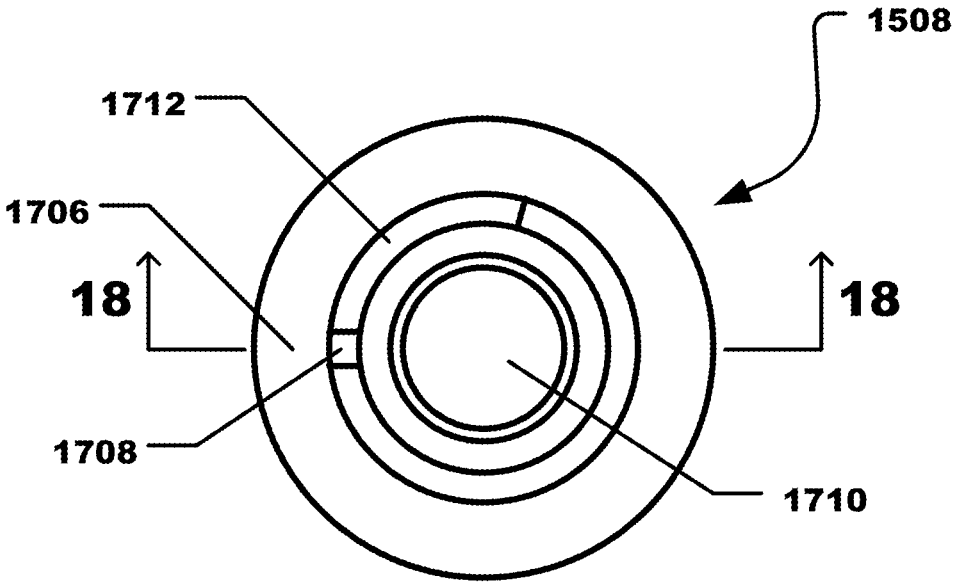
FIG. 17 includes a plan view of an adapter in accordance with another particular embodiment.

Referring now to FIG. 15 through FIG. 17, another embodiment of a paint cup assembly is shown and is generally designated 1500. As illustrated, the paint cup assembly 1500 can include a paint liner 1502. A ring 1504 can fit around an end of the paint liner 1502. Further, the ring 1504 can threadably engage a cap 1506 and capture the end of the pain liner 1502 between the ring 1504 and the cap 1506. The cap 1506 can be configured to engage an adapter 1508.

In a particular aspect, the paint liner 1502 can be substantially similar to the paint liner 202 described above. Further, the ring 1504 can be similar in construction to the hub 312 of the extended ring 204 described above. In lieu of the ring 1504 illustrated in FIG. 15, the extended ring 204 can be included in the paint cup assembly 1500.

In general, the cap 1506 can include a proximal end 1510 and a distal end 1512. Further, the cap 1506 can include a generally flat surface 1514 at the distal end 1512 and an outlet tube 1516 can extend from the generally flat surface 1514 of the cap 1506. In a particular aspect, the cap 1506 can include many, if not all, of the features described above in conjunction the cap 206 illustrated in FIG. 3.

In addition to those features, the cap 1506 can also include a structural feature 1520 that can extend from the flat surface 1514 of the cap 1506. The structural feature 1500 can be a protrusion, a recess, or a combination thereof. Further, the structural feature 1500 can include multiple protrusions, recesses, or combinations thereof. As illustrated in FIG. 15 and FIG. 16, the structural feature 1520 can be formed adjacent to, or near, the outlet tube 1516 of the cap 1506. Specifically, the structural feature can be formed adjacent to an outer perimeter of the outlet tube 1516.

Figure 18:
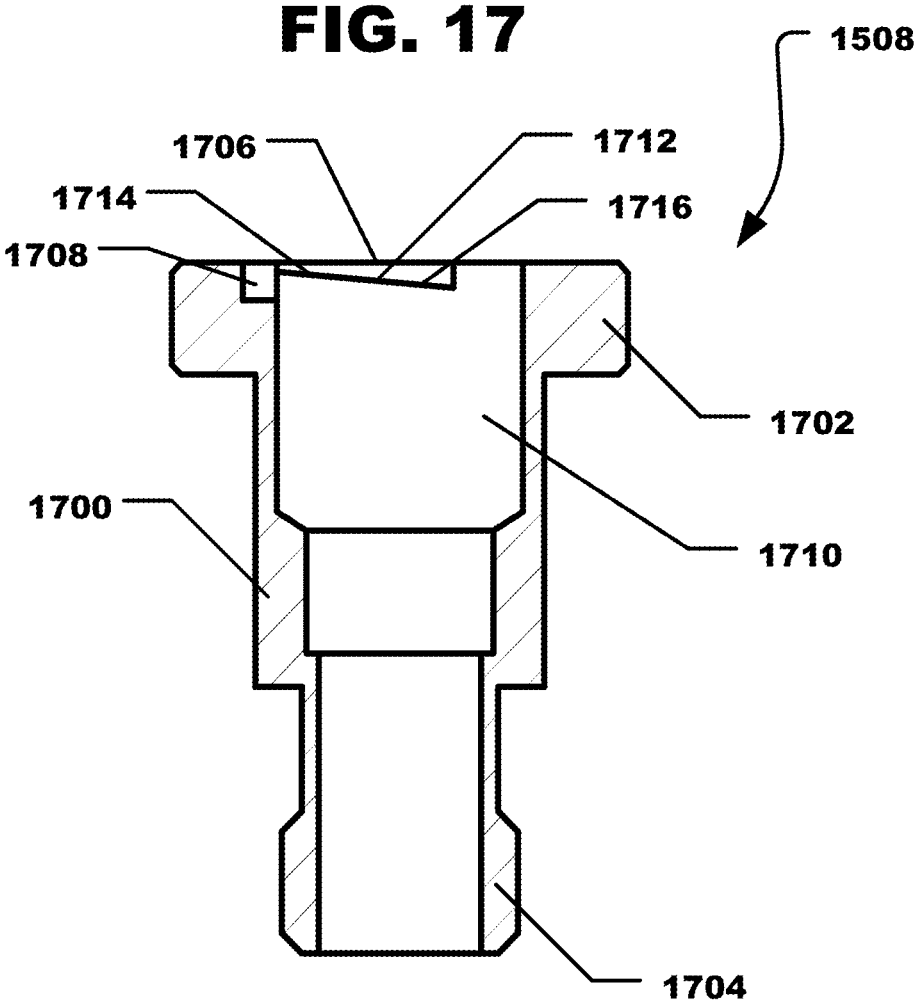
FIG. 18 includes a cross-sectional view of an adapter in accordance with a particular embodiment taken along Line 18-18 in FIG. 17.

FIG. 17 and FIG. 18 indicate that the adapter 1508 can include an adapter body 1700 that can have a proximal end 1702 and a distal end 1704. Further, the adapter 1508 can include a top face 1706 at the proximal end 1702 of the adapter 1508. As illustrated in FIG. 17 and FIG. 18, the adapter 1508 can include a complementary structural feature 1708 formed in the top face 1706 of the adapter 1508 adjacent to a bore 1710 that extends through the adapter body 1700. The complementary structural feature 1708 can be a protrusion, a recess, or a combination thereof. Further, the complementary structural feature 1708 can include multiple protrusions, recesses, or combinations thereof. The complementary structural feature 1708 can be configured to engage the structural feature 1520 formed on the cap 1506. For a direct connection between the paint cup assembly 1500 and a paint spray gun, the complementary structural feature 1708 can be formed on a paint spray gun, at or near a paint inlet thereof.

As shown in FIG. 17 and FIG. 18, the adapter 1508 can be include a ramped portion 1712 that can be formed in the top face 1706 of the adapter 1508 adjacent to the complementary structural feature 1708. The ramped portion 1712 can engage the structural feature 1520 on the cap 1506 in order to increase a first rotational resistance, described below, that can be felt by the user as the paint cup assembly 1500 is engaged with the adapter 1508. The ramped portion 1602 can be formed at an angle, α, with respect to the top face 1706 of the adapter and a can be ≥1°, such as ≥2°, or ≥3°. Further, α can be ≤10°, such as ≤9°, ≤8°, ≤7°, ≤6°, or ≤5°. In a particular aspect, α can be within a range between and including any of the values for α described above.

As depicted in FIG. 18, the ramped portion 1712 can include a proximal end 1714 adjacent to the complementary structural feature 1708 and the ramped portion 1712 can extend to a distal end 1716 that is distanced from the complementary structural feature 1708. A distance between the ramped portion 1602 and the top face 1706 of the adapter 1508 can increase from the proximal end 1714 of the ramped portion 1712 to the distal end 1716 of the ramped portion 1712. As the cap 1506 is engaged with the adapter 1508, the structural feature 1520 on the cap 1506 can move across the ramped portion 1712 before the structural feature snaps into, or otherwise engages, the complementary structural feature 1708 on the adapter 104. As the structural feature 1520 on the cap 1506 moves across the ramped portion 1712 that angle of the ramped portion 1712 can cause the ramped portion 1712 act as a wedge against the structural feature 1520 and increase the rotational resistance experienced by a user.

It can be appreciated that a similar ramped portion can be formed on the cap 1506 of the paint cup assembly 1500 adjacent to the structural feature 1520 formed thereon.

In a particular aspect, the structural features 1520, 1708 can cooperate with each other to form a tactile feedback mechanism that can provide a tactile indication to a user that can be felt by the user while the user is engaging the spray cup assembly 1500 with a paint sprayer, e.g., directly to the paint sprayer or indirectly to the paint sprayer via an adapter 1508. The tactile indication can include two stages. First, the tactile indication can provide a first rotational resistance to the user. The first rotational resistance can require a torque to overcome that is greater than the normal engagement torque required to rotate the paint cup assembly 1500 relative to the adapter 1508 without the tactile feedback mechanism. The second rotational resistance can be substantially less than the first rotational resistance and can occur when the structural feature 1520 on the paint cup assembly 1500 engages the complementary structural feature 1708 on the adapter 1508.

The tactile indication can occur within at least about 1° from an end of rotation of the paint cup assembly with respect to the paint spray gun, such at least about 2°, at least about 3°, at least about 4°, at least about 5°, at least about 10°, at least about 15°, or even at least about 20°. Further, the tactile indication can occur within no greater than 180° from an end of rotation of the paint reservoir assembly with respect to the paint spray gun, such as no greater than about 170°, no greater than about 160°, no greater than about 150°, no greater than about 100°, no greater than about 60°, or no greater than about 45°. The tactile indication can occur within a range between and including 1° to 180° from an end of rotation of the paint cup assembly 1500 with respect to the adapter 1508 or paint spray gun.

In a particular aspect, prior to complete engagement of the paint reservoir assembly with the paint spray gun, the tactile indication includes a first rotational resistance followed by a second rotational resistance. The first torsional resistance is greater than the second torsional resistance. The first rotational resistance can be at least about 2 times greater than the second rotational resistance, at least about 3 times, or at least about 5 times. The first rotational resistance can be not greater than about 10 times greater than the second rotational resistance, not greater than 8 times, or not greater than 7 times. The first rotational resistance can be within a range between and including at least about 2 times greater than the second rotational resistance and not greater than about 10 times greater than the second rotational resistance.

Further, the first rotational resistance can be greater than a normal engagement resistance between the paint cup assembly and the paint spray gun prior to the occurrence of the tactile indication. The first rotational resistance can be at least about 2 times greater than the normal engagement resistance, at least about 3 times greater, at least about 4 times greater, or at least about 5 times greater. The first rotational resistance can not greater than about 10 times greater than the normal engagement resistance, not greater than 8 times, or not greater than 7 times. The first rotational resistance can be within a range between and including at least about 2 times greater than the normal engagement resistance and not greater than about 10 times greater than the normal engagement resistance.

The first torsional resistance can occur within at least about 10° from the end of rotation of the paint reservoir assembly with respect to the paint spray gun, at least about 15°, at least about 20°, or at least about 30°. Further, the first torsional resistance occurs within no greater than about 180° from the end of rotation of the paint reservoir assembly with respect to the paint spray gun, no greater than about 90°, no greater than about 60°, or no greater than about 45°. The first torsional resistance can occur within a range between and including 10° and 180° from the end of rotation. The end of rotation occurs when the paint cup assembly is fully engaged with the paint spray gun.

The second torsional resistance can occur within at least about 1° of the end of rotation of the paint reservoir assembly with respect to the paint spray gun, at least about 2°, at least about 3°, or at least about 5°. Moreover, the second torsional resistance occurs within no greater than about 10° of the end of rotation of the paint reservoir assembly with respect to the paint spray gun, no greater than about 9°, no greater than about 8°, or no greater than about 7°. The second torsional resistance can occur within a range between and including 1° and 10° from the end of rotation.

In a particular aspect, the tactile indication is configured to prevent a user from over engaging the cap with respect to the paint spray gun. Further, the tactile indication is configured to prevent a user from over tightening the cap with respect to the paint spray gun. In particular, the tactile indication can provide a signal to a user to cease an engagement operation between the paint reservoir assembly and the paint spray gun. The engagement operation can include angular motion between the paint reservoir assembly and the paint spray gun. Also, the engagement operation can include linear motion between the paint reservoir assembly and the paint spray gun. Alternatively, the engagement operation comprises a combination of angular motion and linear motion between the cap and the paint inlet.

In one embodiment, the tactile indication can be felt by a user just prior to the paint reservoir assembly properly engaging the paint spray gun. For example, the tactile indication can include a snap that is felt by a user just before, or as, a paint reservoir assembly reaches full engagement with the paint spray gun.

In another aspect, the tactile indication can be a vibration. The vibration can be a mechanical vibration or a sonic vibration. The vibration can be a click, or a series of clicks, that can be felt by a user, heard by a user, or a combination thereof. Further, the vibration can be felt by the user through the paint cup assembly.

Figure 19:
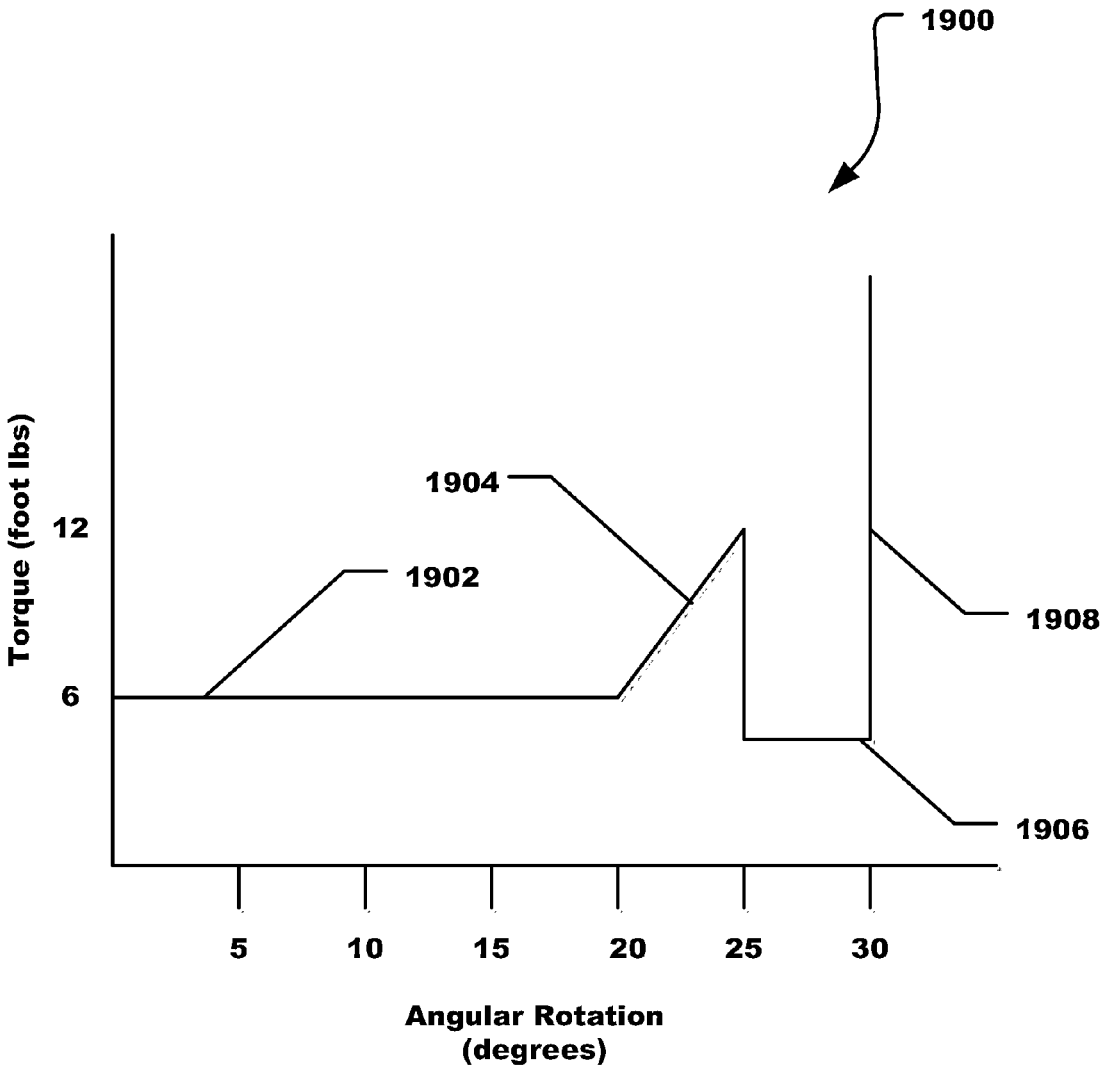
FIG. 19 includes a graph showing torque and angular rotation during engagement of an embodiment of a paint cup assembly in accordance with a particular embodiment with a paint spray gun.

Referring to FIG. 19, a torque diagram showing the engagement torque of a paint cup assembly, or paint reservoir assembly, with a paint spray gun or adapter is shown. As shown, the torque diagram shows the engagement torque plotted versus angular rotation of the paint cup assembly relative to the paint spray gun. The torque diagram shows a first portion 1902 that represents the normal torque required to overcome the normal engagement resistance of the paint cup assembly relative to the paint spray gun. The normal engagement resistance is that resistance provided by the engagement of male threads on the paint cup assembly with female threads on the adapter, e.g., before the structural feature on the cap begins sliding against the ramped portion on the adapter.

The torque diagram 1900 can include a second portion 1904. The second portion represents the torque required to overcome the first rotational resistance provided by the structural feature 1520 on the paint cup assembly 1500 and the ramped portion 1712 of the adapter 1508 just before to the structural feature 1520 on the paint cup assembly 1500 engages the complementary structural feature 1708 on the adapter 1508. The torque diagram 1900 can also include a third portion 1906 that represents the torque required to overcome the second rotational resistance that occurs after the structural feature 1520 on the paint cup assembly 1500 4 engages the structural feature 1708 on the adapter 1508. As shown, the second rotational resistance is substantially less than the first rotational resistance. Finally, the torque diagram 1900 includes a spike 1908 in the torque that would occur if a user attempted to over-rotate the paint cup assembly 1500 with respect to the adapter 1508.

With the configuration described herein, the paint cup assembly provides a paint cup assembly that is substantially leak-proof regardless of the orientation of the paint cup assembly. The paint cup assembly also provides a tactile feed back mechanism that can prevent a user from over-tightening the paint cup assembly when engaging the paint cup assembly with a paint spray gun via an adapter.

Further, the paint cup assembly can be connected to a paint spray gun while the paint spray gun is in an upright position typically used while expelling paint from the paint spray gun. The valve maintains paint within the paint cup assembly until the paint cup assembly is engaged with the paint spray gun and the adapter opens the valve. Further, when the paint cup assembly is disengaged with the paint spray gun, the valve returns to a closed position and seals the outlet of the paint cup assembly. The paint cup assembly can be stored for later use and any remaining paint can stay fresh and usable for an extended period of time.

In a particular aspect, the paint spray gun can incorporate one or more of the features of the adapter and in such an aspect, the paint cup assembly can be directly engaged with the paint spray gun without using the adapter. Accordingly, a post within the paint spray gun can be configured to open the valve when the paint cup assembly is directly engaged with the paint spray gun.

Note that not all of the activities described above in the general description or the examples are required, that a portion of a specific activity may not be required, and that one or more further activities can be performed in addition to those described. Still further, the order in which activities are listed is not necessarily the order in which they are performed.

Certain features that are, for clarity, described herein in the context of separate embodiments, can also be provided in combination in a single embodiment. Conversely, various features that are, for brevity, described in the context of a single embodiment, can also be provided separately or in any subcombination. Further, reference to values stated in ranges includes each and every value within that range.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments can also be provided in combination in a single embodiment, and conversely, various features that are, for brevity, described in the context of a single embodiment, can also be provided separately or in any subcombination. Further, reference to values stated in ranges includes each and every value within that range. Many other embodiments can be apparent to skilled artisans only after reading this specification. Other embodiments can be used and derived from the disclosure, such that a structural substitution, logical substitution, or another change can be made without departing from the scope of the disclosure. Accordingly, the disclosure is to be regarded as illustrative rather than restrictive.

What is claimed is:

1. A paint cup assembly for a paint spray gun, comprising:
a paint reservoir assembly including:
a paint reservoir; and
a cap configured to engage the paint reservoir, wherein the cap comprises:
an outlet tube;
a coupling feature comprising at least one of threads, grooves, or locking pins adapted to engage the paint reservoir assembly to the paint spray gun; and
a structural feature adapted to form a tactile feedback mechanism to provide a tactile indication to a user when the coupling feature is fully engaged with a complementary structural feature on the paint spray gun,
wherein the coupling feature is disposed on the outlet tube, and wherein the structural feature is disposed on the cap at a location spaced apart from the outlet tube; and
wherein the structural feature on the paint reservoir assembly comprises a protrusion or a recess.

2. The paint cup assembly of claim 1, wherein the paint cup assembly further comprises an adapter adapted to be disposed between the paint spray gun and the paint reservoir assembly, and wherein the complementary structural feature is disposed on a longitudinal face of the adapter.

3. The paint cup assembly of claim 1, wherein the complementary feature on the paint spray gun comprises the other of a protrusion or a recess.

4. The paint cup assembly of claim 1, wherein the coupling feature comprises threads.

5. The paint cup assembly of claim 1, wherein the tactile indication occurs within at least 1° from an end of rotation of the paint reservoir assembly with respect to the paint spray gun.

6. The paint cup assembly of claim 1, wherein prior to complete engagement of the paint reservoir assembly with the paint spray gun, the tactile indication includes a first rotational resistance followed by a second rotational resistance, wherein the first rotational resistance is greater than the second rotational resistance.

7. The paint cup assembly of claim 6, wherein the first rotational resistance is at least 2 times greater than the second rotational resistance.

8. The paint cup assembly of claim 6, wherein the first rotational resistance occurs within at least 10° from an end of rotation of the paint reservoir assembly with respect to the paint spray gun.

9. The paint cup assembly of claim 6, wherein the second rotational resistance occurs within at least 1° of the end of rotation of the paint reservoir assembly with respect to the paint spray gun.

10. The paint cup assembly of claim 1, wherein the paint reservoir comprises a collapsible paint liner.

11. The paint cup assembly of claim 1, wherein the paint reservoir assembly further comprises a ring and a paint liner, and wherein the ring circumscribes the paint liner.

12. The paint cup assembly of claim 2, wherein the adapter further comprising a ramped portion disposed adjacent to the complementary structural feature.

13. The paint cup assembly of claim 2, wherein the adapter comprises a ramped portion that can engage the structural feature on the cap.

14. The paint cup assembly of claim 13, wherein the ramped portion acts as a wedge against the structural feature.

15. A paint cup assembly for a paint spray gun, comprising:

a paint reservoir assembly including:

a paint reservoir; and a cap engaged with the paint reservoir, wherein the cap comprises:

an outlet tube;

a coupling feature comprising at least one of threads, grooves, or locking pins disposed on the outlet tube and adapted to engage the paint reservoir assembly to the paint spray gun; and a structural feature disposed on an upper surface of the cap at a location axially spaced apart from the outlet tube adapted to form a tactile feedback mechanism to provide a tactile indication to a user when the coupling feature is fully engaged with a complementary structural feature on the paint spray gun; and wherein the structural feature on the paint reservoir assembly comprises a protrusion or a recess.

16. The paint cup assembly of claim 15, wherein the structural feature is adapted to provide tactile indication to the user when the coupling feature is fully engaged with the complementary structural feature while the coupling feature is rotatably engaged with the complementary structural feature.

17. The paint cup assembly of claim 15, wherein the coupling feature comprises threads, and wherein the structural feature comprises at least one protrusion.

18. The paint cup assembly of claim 15, wherein the coupling feature comprises grooves.

19. The paint cup assembly of claim 15, wherein the coupling feature comprises locking pins.

* * * * *